US009657379B2

(12) United States Patent
Saitoh et al.

(10) Patent No.: US 9,657,379 B2
(45) Date of Patent: May 23, 2017

(54) FORGING STEEL

(75) Inventors: Hajime Saitoh, Tokyo (JP); Tatsuro Ochi, Tokyo (JP); Masayuki Hashimura, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 1024 days.

(21) Appl. No.: 12/312,010

(22) PCT Filed: Apr. 10, 2008

(86) PCT No.: PCT/JP2008/057459

§ 371 (c)(1),
(2), (4) Date: Apr. 21, 2009

(87) PCT Pub. No.: WO2008/126939

PCT Pub. Date: Oct. 23, 2008

(65) Prior Publication Data

US 2010/0047106 A1 Feb. 25, 2010

(30) Foreign Application Priority Data

Apr. 11, 2007 (JP) ..... 2007-104025
Oct. 10, 2007 (JP) ..... 2007-264483

(51) Int. Cl.

| | |
|---|---|
| ***C22C 38/22*** | (2006.01) |
| ***C22C 38/14*** | (2006.01) |
| ***C22C 38/08*** | (2006.01) |
| ***C22C 38/06*** | (2006.01) |
| ***C22C 38/04*** | (2006.01) |

(Continued)

(52) U.S. Cl.

CPC ..... *C22C 38/04* (2013.01); *C21D 1/06* (2013.01); *C21D 8/06* (2013.01); *C22C 38/06* (2013.01)

(58) Field of Classification Search

None

See application file for complete search history.

(56) References Cited

U.S. PATENT DOCUMENTS 6,162,389 A * 12/2000 Hase et al. ..... 420/92
2003/0111144 A1 6/2003 Matsuoka et al.

(Continued)

FOREIGN PATENT DOCUMENTS

CN 1511673 7/2004
EP 1 195 447 4/2002

(Continued)

OTHER PUBLICATIONS

English translation of JP 2004-052099.*

(Continued)

*Primary Examiner* — Yoshitoshi Takeuchi
(74) *Attorney, Agent, or Firm* — Birch, Stewart, Kolasch & Birch, LLP

(57) ABSTRACT

This invention provides a forging steel excellent in forgeability, which forging steel comprises, in mass %, C: 0.001 to less than 0.07%, Si: 3.0% or less, Mn: 0.01 to 4.0%, Cr: 5.0% or less, P: 0.2% or less, S: 0.35% or less, Al: 0.0001 to 2.0%, N: 0.03% or less, one or both of Mo: 1.5% or less (including 0%) and Ni: 4.5% or less (including 0%), and a balance of iron and unavoidable impurities; wherein Di given by the following Equation (1) is 60 or greater:

$$Di=5.41\times Di(\mathrm{Si})\times Di(\mathrm{Mn})\times Di(\mathrm{Cr})\times Di(\mathrm{Mo})\times Di(\mathrm{Ni})\times Di(\mathrm{Al}) \quad (1)$$

2 Claims, 3 Drawing Sheets

(51) Int. Cl.
*C21D 1/06* (2006.01)
*C21D 8/06* (2006.01)

(56) References Cited

U.S. PATENT DOCUMENTS

| | | | | |
|---|---|---|---|---|
| 2004/0149359 | A1 | 8/2004 | Michaud et al. | |
| 2006/0081312 | A1 * | 4/2006 | Yokoi | C22C 38/001 148/533 |

FOREIGN PATENT DOCUMENTS

| | | | | |
|---|---|---|---|---|
| FR | 2436825 | * | 4/1980 | C22C 38/60 |
| JP | 60-159155 | | 8/1985 | |
| JP | 62-4819 | | 1/1987 | |
| JP | 62-023930 | | 1/1987 | |
| JP | S62235420 | * | 10/1987 | C21D 6/00 |
| JP | 63-004048 | | 1/1988 | |
| JP | 63-183157 | | 7/1988 | |
| JP | 02-190442 | | 7/1990 | |
| JP | 05-171262 | | 7/1993 | |
| JP | 2735161 | * | 4/1998 | C22C 38/00 |
| JP | 11-335777 | | 12/1999 | |
| JP | 2000-212683 | | 8/2000 | |
| JP | 2001-303172 | | 10/2001 | |
| JP | 2002-69571 | | 3/2002 | |
| JP | 2004-052099 | * | 2/2004 | C22C 38/00 |
| JP | 2001-081529 | | 3/2004 | |
| JP | 2006-161144 | * | 6/2006 | C22C 38/00 |
| JP | 2006-307273 | * | 11/2006 | C22C 38/00 |
| JP | 2007-050480 | | 3/2007 | |
| KR | 2002-0021646 | | 3/2002 | |
| WO | WO 01/77400 | | 10/2001 | |
| WO | 2007/007423 | | 1/2007 | |

OTHER PUBLICATIONS

English translation of JP 2006-161144 (2006).*
English translation of JP 2006-307273 (2006).*
English translation of JPS62235420 (1987).*
English translation of JP2735161 (1998).*
English translation of FR 2436825 (1980).*
Chinese Office Action dated Sep. 19, 2010 issued in corresponding Chinese Application No. 200880000741.2.
Hardening of Steel, pp. 31-32, Sep. 1979.
Handbook of Iron and Steel IV, Third Edition, p. 122, Oct. 1981.
International Search Report dated Jul. 22, 2008 issued in corresponding PCT Application No. PCT/JP2008/057459.
Extended European Search Report in European application No. 08740529.6 dated Dec. 16, 2010.
Korean Office Action dated Mar. 18, 2011 issued in corresponding Chinese Application No. 20097005326.
Cailiao Chengxing Jishu Jichu, Higher Education Press, Beijing, Jul. 31, 2010, 3 pages (with conscise statement of relevance from the Chinese Office Action issued in related Chinese Patent Application No. 201410829870.X—1 page).

* cited by examiner

FORGING STEEL

FIELD OF THE INVENTION

This invention relates to a forging steel to be subjected to various kinds of machining and heat treatment after forging.

DESCRIPTION OF THE RELATED ART

Steels used in mechanical structures generally contain Mn or Cr, or Cr and Mo in combination, or these together with Ni and other elements. A steel material obtained by casting and rolling is processed into steel components by forging, cutting and other machining and heat treatment.

In manufacturing steel components, the proportion of the labor and expense involved accounted for by the forging process is large and decreasing it is therefore an important issue. For this, it is necessary to improve manufacturing performance by, for example, extending die life during forging and reducing the number of forgings. Although hot forging places small load on the forging machine because the steel is forged in a temperature range where the deformation resistance of the steel is low, it has the disadvantages of much scale adhering to the steel and dimensional accuracy of the forged component being hard to achieve. Warm forging mitigates the drawbacks of hot forging since it involves little scale adherence and is advantageous as regards dimensional accuracy. However, it has the disadvantage of deformation resistance being higher than in hot forging. Cold forging is advantageous in being scale free and good in dimensional accuracy. But it has the major disadvantage of still higher forging load. Warm forging and cold forging, which offer benefits not obtainable with hot forging, have witnessed extensive development of steel softening technologies.

Regarding steel suitable for warm forging, Japanese Patent Publication (A) No. S63-183157, for example, teaches a warm forging steel improved in carburization performance by controlling C content to 0.1 to 0.3% and optimizing the contents of Ni, Al and N. Japanese Patent Publication (A) No. S63-4048 teaches a warm forging steel improved in carburization performance by controlling C content to 0.1 to 0.3% and adding Te to a content of 0.003 to 0.05%. Japanese Patent Publication (A) No. H2-190442 teaches a warm forging steel improved in carburization performance by controlling C content to 0.1 to 0.3% and adding Cu to a content of 0.1 to 0.5% and Ti and other elements in suitable amounts.

Japanese Patent Publication (A) Nos. S60-159155 and S62-23930 teach warm forging steels softened by controlling C content to 0.07 to 0.25% and improved in carburization performance by adding optimal amounts of Nb, Al and N.

Regarding cold forging, Japanese Patent Publication (A) Nos. H11-335777 and 2001-303172, for example, teach forging steels improved in cold forgeability by reducing Si and Mn contents in the carbon content range of 0.1 to 0.3%, thereby softening the steel. Japanese Patent Publication (A) No. H5-171262 teaches a forging steel improved in cold forgeability by controlling carbon content to 0.05 to 0.3%, thereby softening the steel.

SUMMARY OF THE INVENTION

Although these prior art steels maintain adequate hardness after carburization, they remain insufficient in the point of deformation resistance during forging.

The object of the present invention is to provide a steel very excellent in forging performance, which steel is much lower than conventional steels in deformation resistance during cold forging and warm forging, as well as during hot forging, exhibits required strength after heat treatment following forging, and thus enables improved forging die life and reduction of number of forgings.

The inventors conducted a detailed study in order to achieve the object of the present invention. As a result, they learned that greatly reducing carbon content from the 0.2% level considered necessary for ensuring strength after quenching and tempering of a conventional steel (e.g., SCr420) markedly lowers deformation resistance during forging, and in addition, makes it possible to ensure post-forging component strength by controlling the ranges of components in line with effective hardening depth after carburization, quenching and tempering.

The gist of the present invention is as set out below.

(1) A forging steel excellent in forgeability comprising, in mass %:

C: 0.001 to less than 0.07%,
Si: 3.0% or less,
Mn: 0.01 to 4.0%,
Cr: 5.0% or less,
P: 0.2% or less,
S: 0.35% or less,
Al: 0.0001 to 2.0%,
N: 0.03% or less,
one or both of Mo: 1.5% or less (including 0%) and Ni: 4.5% or less (including 0%), and a balance of iron and unavoidable impurities;

wherein Di given by the following Equation (1) is 60 or greater:

$$Di=5.41\times Di(\mathrm{Si})\times Di(\mathrm{Mn})\times Di(\mathrm{Cr})\times Di(\mathrm{Mo})\times Di(\mathrm{Ni})\times Di(\mathrm{Al}) \quad (1),$$

where
Di(Si)=0.7×[% Si]+1,
Di(Mn)=3.335×[% Mn]+1 when Mn≤1.2%,
Di(Mn)=5.1×[% Mn]−1.12 when 1.2%<Mn,
Di(Ni)=0.3633×[% Ni]+1 when Ni≤1.5%,
Di(Ni)=0.442×[% Ni]+0.8884 when 1.5%<Ni≤1.7,
Di(Ni)=0.4×[% Ni]+0.96 when 1.7%<Ni≤1.8,
Di(Ni)=0.7×[% Ni]+0.42 when 1.8%<Ni≤1.9,
Di(Ni)=0.2867×[% Ni]+1.2055 when 1.9%<Ni,
Di(Cr)=2.16×[% Cr]+1,
Di(Mo)=3×[% Mo]+1,
Di(Al)=1 when Al≤0.05%, and
Di(Al)=4×[% Al]+1 when 0.05%<Al,
a symbol in brackets [ ] indicating content (mass %) of the element concerned.

(2) A forging steel excellent in forgeability according to (1), further comprising, in mass %:

Cu: 0.6 to 2.0%, wherein Di given by the following Equation (2) instead of Equation (1) is 60 or greater:

$$Di=5.41\times Di(\mathrm{Si})\times Di(\mathrm{Mn})\times Di(\mathrm{Cr})\times Di(\mathrm{Mo})\times Di(\mathrm{Ni})\times Di(\mathrm{Al})\times Di(\mathrm{Cu}) \quad (2),$$

where
Di(Si), Di(Mn), Di(Cr), Di(Mo), Di(Ni) and Di(Al), are defined as in Equation (1) and Di(Cu) is defined as
Di(Cu)=1 when Cu≤1% and
Di(Cu)=0.36248×[% Cu]+1.0016 when 1%<Cu,
a symbol in brackets [ ] indicating content (mass %) of the element concerned.

(3) A forging steel excellent in forgeability according to (1), further comprising, in mass %:

B: not less than BL given by Equation (7) below and not greater than 0.008% and

Ti: 0.15% or less, (including 0%)

wherein Di given by the following Equation (3) instead of Equation (1) is 60 or greater:

$$Di=5.41\times Di(\mathrm{Si})\times Di(\mathrm{Mn})\times Di(\mathrm{Cr})\times Di(\mathrm{Mo})\times Di(\mathrm{Ni})\times Di(\mathrm{Al})\times 1.976 \quad (3),$$

where

Di(Si), Di(Mn), Di(Cr), Di(Mo), Di(Ni) and Di(Al) are defined as in Equation (1), and wherein $$BL=0.0004+10.8/14\times([\%\ \mathrm{N}]-14/47.9\times[\%\ \mathrm{Ti}]) \quad (7)$$

where ([% N]−14/47.9×[% Ti]) of less than 0 is treated as 0, a symbol in brackets [ ] indicating content (mass %) of the element concerned.

(4) A forging steel excellent in forgeability according to (2), further comprising, in mass %:

B: not less than BL given by Equation (7) below and not greater than 0.008% and

Ti: 0.15% or less (including 0%), wherein Di given by the following Equation (4) instead of Equation (2) is 60 or greater:

$$Di=5.41\times Di(\mathrm{Si})\times Di(\mathrm{Mn})\times Di(\mathrm{Cr})\times Di(\mathrm{Mo})\times Di(\mathrm{Ni})\times Di(\mathrm{Al})\times Di(\mathrm{Cu})\times 1.976 \quad (4),$$

where

Di(Si), Di(Mn), Di(Cr), Di(Mo), Di(Ni), Di(Al) and Di(Cu) are defined as in Equation (2), and wherein $$BL=0.0004+10.8/14\times([\%\ \mathrm{N}]-14/47.9\times[\%\ \mathrm{Ti}]) \quad (7)$$

where ([% N]−14/47.9×[% Ti]) of less than 0 is treated as 0, a symbol in brackets [ ] indicating content (mass %) of the element concerned.

(5) A forging steel excellent in forgeability according to (1) or (2), further comprising, in mass %:

Ti: 0.005 to 0.15%.

(6) A forging steel excellent in forgeability according to any of (1) to (5), further comprising, in mass %, one or both of:

Nb: 0.005 to 0.1% and

V: 0.01 to 0.5%.

(7) A forging steel excellent in forgeability according to any of (1) to (6), further comprising, in mass %, one or more of:

Mg: 0.0002 to 0.003%,

Te: 0.0002 to 0.003%,

Ca: 0.0003 to 0.003%,

Zr: 0.0003 to 0.005%, and

REM: 0.0003 to 0.005%.

DETAILED DESCRIPTION OF THE INVENTION

The present invention is explained in detail in the following.

C: 0.001 to less than 0.07% and Di 60 or greater

As the C and Di ranges are the most important requirements of the present invention, they will be discussed in detail.

Numerous ingots of compositions controlled to the following component ranges were produced and rolled into steel materials: C content of 0.001 to 0.1%, Cr: 0 to 5.0%, Si: 0 to 3.0%, P: 0 to 0.2%, Mn: 0.01 to 4.0%, Mo: 0 to 1.5%, Ni: 0 to 4.5%, S: 0 to 0.35%, Al: 0.0001 to 2.0%, N: 0.03% or less, and the balance of Fe an unavoidable impurities.

Samples cut from the steel materials and ground into cylindrical test pieces of 14 mm diameter by 21 mm length were subjected to compression testing at a strain rate of 15/s at room temperature. The maximum flow stress up to equivalent strain of 0.5 was investigated.

Samples cut from the aforesaid rolled steels and ground into test pieces of 17.5 mm diameter by 52.5 mm length were subjected to carburization treatment. Carburization was conducted at 950° C. under carbon potential of 0.8% for 360 min and was followed by quenching and tempering at 160° C. The quenched and tempered test piece was cut crosswise, the cross-sectional surface was polished, and the HV hardness distribution in the cross-section was measured inward from the test piece surface under 200 g load using a micro Vickers hardness tester, thereby determining the effective hardening depth (depth at HV 550) in accordance with JIS G 0557 (1996).

Figure 1:
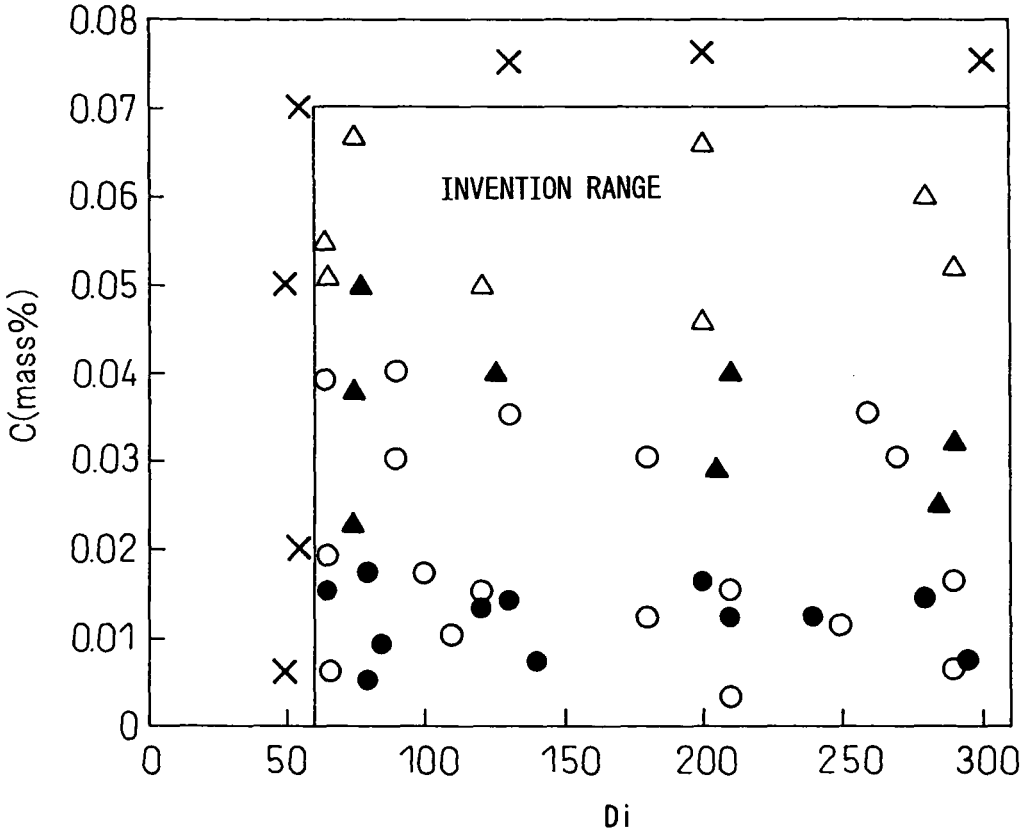
FIG. 1 shows how pass/fail evaluation of deformation resistance at room temperature and 830° C. (compared with SCr420) and hardened layer hardness after carburization (compared with SCr420) differs with C content and Di.

A steel whose deformation resistance in the compression test at room temperature was lower than that of JIS SCr420 steel selected as a typical case hardening steel for comparison (C: 0.20%, Si: 0.25%, Mn: 0.65%, P: 0.011%, S: 0.014%, Cr: 0.92%) by greater than 35% and whose effective hardening depth after carburization, quenching and tempering was 0.6 mm or greater was rated ○ (Excellent). A steel whose deformation resistance was lower than that of JIS SCr420 steel by 15 to 35% and whose effective hardening depth after carburization, quenching and tempering was 0.6 mm or greater was rated Δ (Good). A steel whose deformation resistance was lower than that of JIS SCr420 steel by less than 15% or whose effective hardening depth after carburization, quenching and tempering was less than 0.6 mm was rated x (Poor). The steels were classified using as an index the Di calculated by Equation (1) below indicating the amounts of added alloying elements. The results are shown in FIG. 1:

$$Di=5.41\times Di(\mathrm{Si})\times Di(\mathrm{Mn})\times Di(\mathrm{Cr})\times Di(\mathrm{Mo})\times Di(\mathrm{Ni})\times Di(\mathrm{Al}) \quad (1),$$

where

Di(Si)=0.7×[% Si]+1,

Di(Mn)=3.335×[% Mn]+1 when Mn≤1.2%,

Di(Mn)=5.1×[% Mn]−1.12 when 1.2%<Mn,

Di(Ni)=0.3633×[% Ni]+1 when Ni≤1.5%,

Di(Ni)=0.442×[% Ni]+0.8884 when 1.5%<Ni≤1.7,

Di(Ni)=0.4×[% Ni]+0.96 when 1.7%<Ni≤1.8,

Di(Ni)=0.7×[% Ni]+0.42 when 1.8%<Ni≤1.9,

Di(Ni)=0.2867×[% Ni]+1.2055 when 1.9%<Ni,

Di(Cr)=2.16×[% Cr]+1,

Di(Mo)=3×[% Mo]+1,

Di(Al)=1 when Al≤0.05%, and

Di(Al)=4×[% Al]+1 when 0.05%<Al, a symbol in brackets [ ] indicating content (mass %) of the element concerned.

It can be seen from FIG. 1 that the steels within the range simultaneously satisfying the conditions of adequately low deformation resistance and the specified surface hardness were ones whose C content was less than 0.07% and whose compositions were in the range satisfying Di: 60 or greater.

Next, the same tests were conducted with respect to forging at high temperature. Specifically, numerous ingots of compositions controlled to the following component ranges were produced and rolled into steel materials: C content of 0.001 to 0.1%, Cr: 0 to 5.0%, Si: 0 to 3.0%, P: 0 to 0.2%, Mn: 0.01 to 4.0%, Mo: 0 to 1.5%, Ni: 0 to 4.5%, S: 0 to 0.35%, Al: 0.0001 to 2.0%, N: 0.03% or less, and the balance of Fe an unavoidable impurities.

Samples cut from the steel materials and ground into cylindrical test pieces of 8 mm diameter by 12 mm length were subjected to compression testing at a strain rate of 15/s at 830° C. The maximum flow stress up to equivalent strain of 0.5 was investigated.

Samples cut from the aforesaid rolled steels and ground into test pieces of 17.5 mm diameter by 52.5 mm length were subjected to carburization treatment. Carburization was conducted at 950° C. under carbon potential of 0.8% for 360 min and was followed by quenching and tempering at 160° C. The quenched and tempered test piece was cut crosswise, the cross-sectional surface was polished, and the HV hardness distribution in the cross-section was measured inward from the test piece surface under 200 g load using a micro Vickers hardness tester, thereby determining the effective hardening depth (depth at HV 550) in accordance with JIS G 0557 (1996).

A steel whose deformation resistance in the compression test at 830° C. was lower than that of JIS SCr420 steel selected as a typical case hardening steel for comparison (C: 0.20%, Si: 0.25%, Mn: 0.61%, P: 0.011%, S: 0.014%, Cr: 1.01%) by greater than 35% and whose effective hardening depth after carburization, quenching and tempering was 0.6 mm or greater was rated ● (Excellent). A steel whose deformation resistance was lower than that of JIS SCr420 steel by 15 to 35% and whose effective hardening depth after carburization, quenching and tempering was 0.6 mm or greater was rated ▲ (Good). A steel whose deformation resistance was lower than that of JIS SCr420 steel by less than 15% or whose effective hardening depth after carburization, quenching and tempering was less than 0.6 mm was rated x (Poor). The steels were classified using as an index the Di calculated by Equation (1). The results are shown in FIG. 1.

It can be seen from FIG. 1 that the steels within the range simultaneously satisfying the conditions of adequately low deformation resistance and the specified surface hardness were ones whose C content was less than 0.07% and whose compositions were in the range satisfying Di: 60 or greater. C of 0.02% or less and Di of 60 or greater are preferable.

The inventors presently think the reasons for these phenomena are as follows. Deformation resistance will be considered first. Although every element has solid solution strengthening ability, the one with the highest strengthening ability is C. So if C is reduced to the utmost, considerable softening can be realized. When C content is 0.07% or greater, it is impossible to achieve a pronounced reduction of deformation resistance compared with that of JIS SCr420.

The deformation resistance of iron having bcc (body centered cubic) crystal structure is lower than iron having fcc (face centered cubic) crystal structure. Iron has bcc structure at room temperature but assumes fcc structure at high temperature. C is an fcc stabilizing element. Therefore, if C content is reduced, the fraction accounted for by bcc increases during high-temperature forging, thereby lowering deformation resistance.

Figure 2:
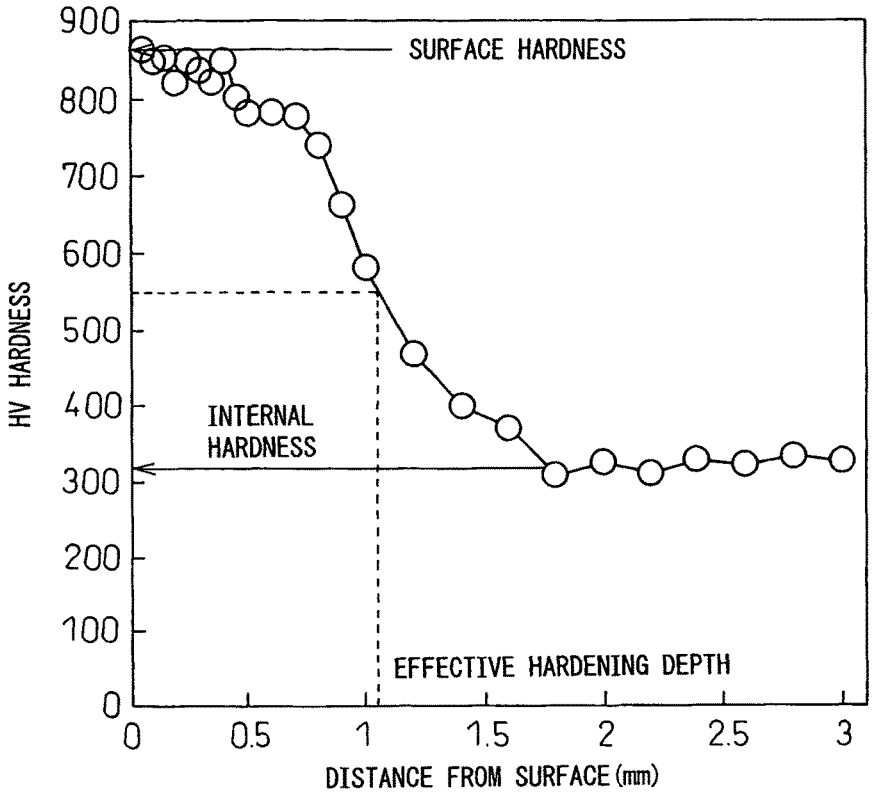
FIG. 2 shows the hardness distribution from the surface of a steel after carburization, quenching and tempering.
Figure 3:
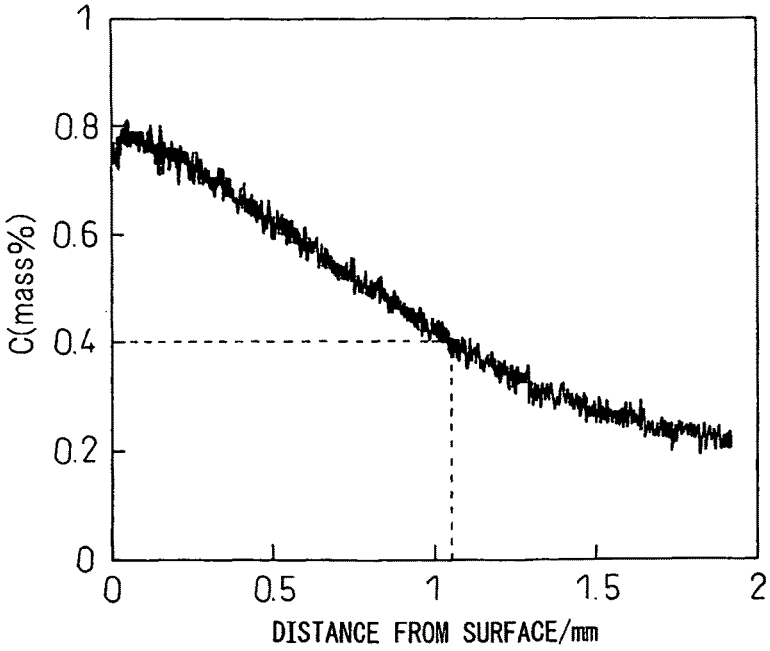
FIG. 3 shows the carbon concentration distribution from the surface of a steel after carburization, quenching and tempering.

Hardness after carburization, quenching and tempering will be considered next. Jominy value is the index generally used for the hardenability of case hardening steels. But steels of low carbon content such as the invention steel have very low Jominy values. Conventionally, therefore, they have never been used as case hardening steels. However, among the properties of a carburized, quenched and tempered component, the surface hardness and effective hardening depth shown in FIG. 2 are two important ones also ordinarily required in the actual component, while in no small number of cases they are not required with respect to the internal hardness (internal uncarburized region hardness). For example, in the case of a gear component, carburization is conducted to ensure tooth flank fatigue strength and a flank hardness of, for instance, Hv 700 or greater is required as a specification. Further, the hertzian stress when teeth mesh and their flanks contact one another reaches a certain depth from the tooth flank and effective hardening depth is therefore required as a specification. Based on the proposition that these two specifications, namely surface hardness and effective hardening depth, are required, conventional thinking can be radically modified. Referring to FIG. 3, when the C concentration distribution in the cross-section of a carburized, quenched and tempered component is measured by EMPA, the depth to which Hv 550 is established, which is the definition of the effective hardening depth, can be seen to correspond to the depth to which the carburization caused C to penetrate at a concentration of around 0.4%. Therefore, even if the hardenability of the steel itself is low, it can be considered possible to obtain adequate effective hardening depth insofar as hardenability is ensured to a depth where 0.4% C is present. When the Di serving as the hardenability index is calculated by the multiplication method, the following equation is used:

$$Di=25.4\times Di(\mathrm{C})\times Di(\mathrm{Si})\times Di(\mathrm{Mn})\times Di(\mathrm{Cr})\times Di(\mathrm{Mo})\times Di(\mathrm{Ni})\times Di(\mathrm{Al})\times Di(\mathrm{Cu}) \quad (5),$$

where $$Di(\mathrm{C})=0.3428[\%\ \mathrm{C}]-0.09486[\%\ \mathrm{C}]^2+0.0908 \quad (6),$$

where [% C] indicates C content (mass %),

Di(Si), Di(Mn), Di(Ni), Di(Cr), Di(Mo) and Di(Al) are defined as in Equation (1), and Di(Cu) is defined as Di(Cu)=1 when Cu≤1% and Di(Cu)=0.36248×[% Cu]+1.0016 when 1%<Cu, where [% Cu] indicates Cu content (mass %).

In accordance with the foregoing, when C: 0.4% is substituted into the equation for determining Di(C), the result becomes Di(C)=0.213, whereby the foregoing Equations (1) and (2) are derived. When the Di determined from Equation (1) or (2) is substantially the same as the Di of JIS SCr420, the comparative steel, it can be presumed possible to achieve adequate hardening and a hardness of HV 550 at the effective hardening depth position.

The Di is the ideal critical diameter of a round bar that following an ideal quench will have 50% martensite at its center and, as such, is an index of steel hardenability. (*Handbook of Iron and Steel IV*, Third Edition, p. 122, compiled by The Iron and Steel Institute of Japan, published by Maruzen, 1981).

Different researchers have reported different study results and calculation methods regarding the effect of alloying elements on Di. Japanese Patent Publication (A) No. 2007-50480, for example, presents Di equations based on the A-255 standard of ASTM (American Society for Testing and Materials). Among non-patent references that set out Di determining methods can be mentioned Shigeo Owaku's *Yakiiresei* (Hardening of Steels), The Nikkan Kogyo Shimbun, 1979.

Equations (1) and (2) appearing in this specification were, as discussed below, formulated by the inventors through experimentation, while referring to the general literature reference *Yakiiresei* by Shigeo Owaku.

Test pieces of the shape specified by JIS G 0561 (2000) were prepared from rolled steels of different compositions varied within the ranges of C content of 0 to 0.8%, Cr: 0 to 5.0%, Si: 0 to 3.0%, P: 0 to 0.2%, S: 0 to 0.35%, Mn: 0 to 4.0%, Mo: 0 to 1.5%, Ni: 0 to 4.5%, Al: 0 to 2.0%, N: 0 to 0.03%, and Cu: 0 to 2.0%. The test pieces were hardened from the austenite region temperature and then subjected to hardenability testing, whereafter the effect of the alloying elements on Di was assessed. The inventors sought to formulate the simplest possible equation from the experimental values by least square approximation. Components whose influencing characteristic curves were approximately linear (Si, Cr and Mo) were expressed simply as linear functions. Components whose influencing characteristic curves were relatively moderate (Mn, Ni, Al and Cu) were divided into content ranges and expressed as a linear function in each range. One component (C), whose influencing characteristic curve was convex and included regions of small radius of curvature, was expressed as a quadratic function. As a result, Equations (5) and (6) were obtained. And by substituting 0.4% for the C content in Equation (6), Equation (1) was obtained for the case of no Cu addition and Equation (2) for the case of Cu addition.

The Di found from Equation (1) or (2) is an index formulated based on this thinking that represents steel hardenability at the depth to which C of 0.4% concentration penetrates by carburization. It is presumed that adequate effective hardening depth after carburization can be realized with a low C steel if the Di is sufficient. As Di of the comparative JIS SCr420 steel calculated by Equation (1) is 60, the conclusion reached in the aforesaid investigation seems reasonable. Although the internal hardness of the invention steel is lower than that of the comparative steel because its C content is low, its internal hardness can be increased by adding alloying elements that increase the Di.

Figure 4:
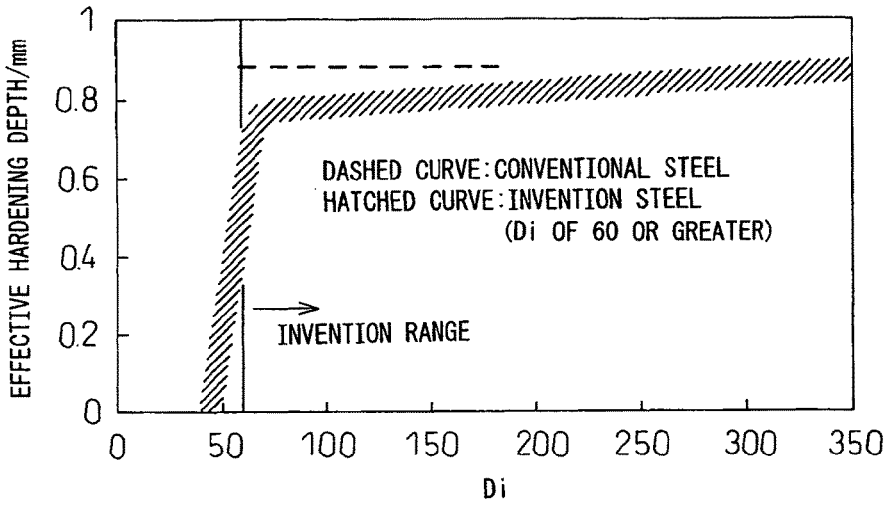
FIG. 4 shows how effective hardening depth varies with Di after carburization, quenching and tempering.

FIG. 4 shows the relationship between Di and effective hardening depth for a conventional steel such as SCr420 containing 0.2% C (dashed curve) and for a steel containing less than 0.07% C (hatched curve), both of which were subjected to the same gas carburization, quenching and tempering (at 950° C. under carbon potential of 1.1% for 176 min and then carbon potential of 0.8% for 110 min, followed by quenching and tempering at 160° C.). The effective hardening depth of even a very low carbon steel can be increased by increasing the Di of the steel. The effective hardening depth can be made still greater by prolonging the carburization time, increasing the carburization temperature, and conducting additional high-frequency heating after carburization.

Although Di must be 60 or greater, it is not subject to an upper limit and can be regulated in line with the effective hardening depth, internal hardness and performance factors (specifications) required by the component after carburization, quenching/hardening and tempering. For example, in order to lower the deformation resistance during forging of the JIS SCr420 having a Di of 80 as calculated by Equation (1) and achieve an effective hardening depth after carburization of around 70 to 90% or greater of the comparative steel, it is effective to select the alloying elements within the invention ranges so as to make Di calculated by Equation (1) 80 or greater. An effective hardening depth that is 90 to 100% or greater than that of the comparative steel can be obtained by further increasing Di.

Figure 5:
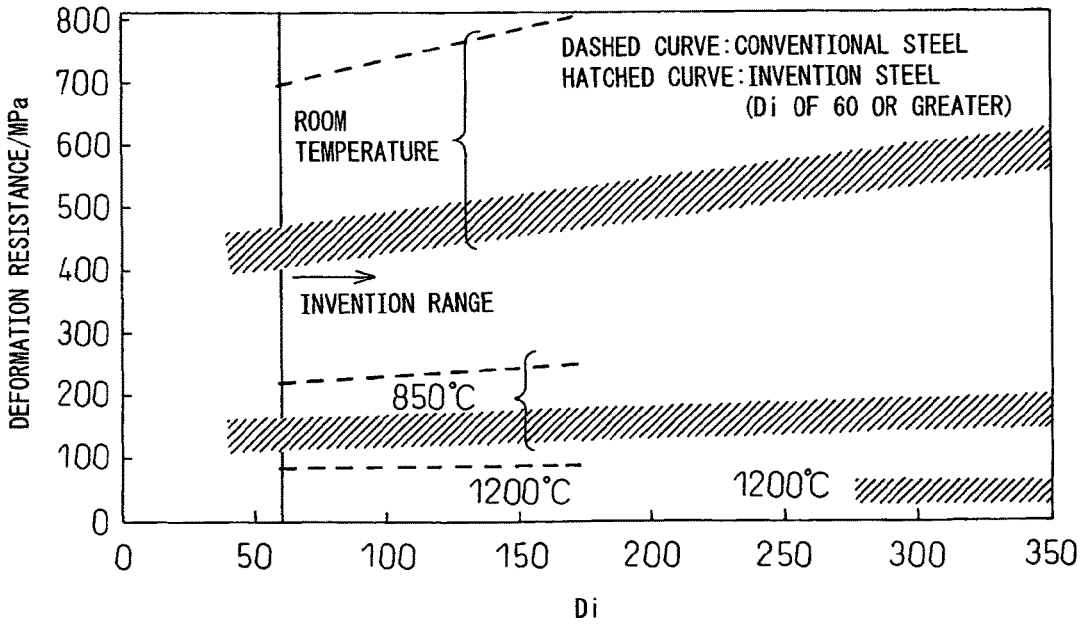
FIG. 5 shows how deformation resistance varies with Di in cold, warm and hot forging.

Thus the present invention achieves a great reduction of deformation resistance relative to conventional steels over a broad temperature range including the cold, warm and hot zones, while simultaneously ensuring adequate effective hardening depth. The performance of the present invention is summarized in FIG. 5. In room temperature (cold) forging, the steel is softened chiefly by reducing solid solution strengthening through C content reduction. In warm forging, the steel is softened by reducing solid solution strengthening through C content reduction and by increasing bcc fraction by use of bcc stabilizing elements. In hot forging, the steel is softened by positive use of bcc stabilizing elements to increase bcc fraction. The reasons for adding elements and specifying their content ranges are explained in detail in the following.

Industrially, reduction of C content to less than 0.001% is difficult and leads to a marked increase in production costs. The lower limit of C content is therefore defined as 0.001%. The upper limit must be defined as less than 0.07% in order to realize adequately low deformation resistance. The C content range is therefore defined as 0.001 to less than 0.07%. When it is necessary to ensure sufficient internal hardness after carburization or carbonitriding, C content is preferably in the range of 0.05 to less than 0.07%. When priority is on realizing low deformation resistance, C content is preferably in the range of 0.001 to less than 0.05%. When further reduction of deformation resistance is desired, C content is preferably in the range of 0.001 to less than 0.03%. A still stronger deformation resistance reducing effect can be obtained by defining C content in the range of 0.001 to less than 0.02%.

Si: 3.0% or less, Mn: 0.01 to 4.0%, Cr: 5.0% or less.

In the case of the typical case hardening steel JIS SCr420, for example, Di of the steel is determined primarily by the three elements Si, Mn and Cr because the steel does not contain Mo or Ni. The value of Di calculated by Equation (1) should be made 60 or greater by selectively combining the three elements. Among the three elements, the hardenability improving effect per unit content (%) is greater in the order of Si→Cr→Mn, while the effect on deformation resistance at room temperature is greater in the order of Si→Mn→Cr. Therefore, when emphasis is on low deformation resistance during cold forging, Cr is preferably added in the largest amount among the three elements. When much Cr is added, intentional addition of Si can be avoided. Addition of Cr in excess of 5.0% impairs carburizability. The upper limit of Cr content is therefore defined as 5.0%.

The ability of alloying elements to cause solid solution strengthening declines with increasing iron temperature. Si, which is high in solid solution strengthening capacity at room temperature, produces little effect at high temperature. Rather, Si can be more effectively exploited as a bcc phase stabilizing element to increase the bcc fraction in the warm and hot forging temperature zones and thus lower deformation resistance to forging in the high-temperature zone.

An Si content in excess of 3.0% impairs carburizability. The upper limit of Si content is therefore defined as 3.0%. As Si greatly increases deformation resistance at room temperature, it is preferably added to a content of 0.7% or less when the steel is to be cold forged. Since Si is a bcc stabilizing element, it is preferably added to a content of 0.1 to 3.0% in the case of a warm- or hot-forging steel.

Mn imparts hardenability to the steel and also works to prevent hot embrittlement by S contained in the steel. The effect of Mn addition on hardenability is obtained at an Mn content of 0.01% or greater. When machinability is not required, addition of S can be omitted but it is impossible to obtain an S content of 0% with current refining technology. The lower limit of Mn content is therefore defined as 0.01%. Addition of Mn to a content exceeding 4.0% markedly increases deformation resistance during forging, so the upper limit of Mn content is defined as 4.0%. The Mn content range is therefore defined as 0.01 to 4.0%. The preferably Mn content range for cold forging applications is 0.01 to 1.0%.

As pointed out earlier, Cr is used to determine Di by selective combination with Si and Mn. However, addition of Cr to a content exceeding 5.0% impairs carburizability. The upper limit of Cr content is therefore defined as 5.0%, preferably 4.0%.

P: 02% or less

P is high in solid solution strengthening capacity at room temperature and its content in a cold-forging steel is therefore preferably held to 0.03% or less, more preferably to 0.02% or less. P can be used as a bcc stabilizing element in a high-temperature forging steel, in which case addition to a content of 0.2% is acceptable. However, addition to a content exceeding 0.2% causes occurrence of flaws during rolling and/or continuous casting. The upper limit of P content is therefore defined as 0.2%.

S: 0.35% or less

S is an unavoidable impurity that causes hot embrittlement. A minimal content is therefore preferable. However, it also helps to improve machinability by combining with Mn in the steel to form MnS. S markedly degrades steel toughness when added to a content exceeding 0.35%. The upper limit of S content is therefore defined as 0.35%.

N: 0.03% or less

Since an N content exceeding 0.03% causes occurrence of flaws during rolling and/or continuous casting, the range of N content is defined as 0.03% or less. When the pinning effect of AlN is used to prevent grain coarsening, N is preferably added to a content of 0.01 to 0.016%.

One or both of Mo: 1.5% or less (including 0%) and Ni: 4.5% or less (including 0%)

Addition of Mo produces mainly two effects. One is in the role Mo plays in increasing Di and controlling the structure of the steel. However, when other elements such as Si, Mn and Cr can fill this role, there is no particular need to add Mo. The other is the effect of Mo addition toward inhibiting softening when the temperature of a steel component such as a gear or continuously variable transmission sheave rises during use. Mo is preferably added to a content of 0.05% or greater for realizing this effect. But, in this case also, there is no particular need to add Mo when the need for elements that soften and lower resistance is satisfied by elements other than Mo. As Mo markedly increases deformation resistance at room temperature, addition to a cold-forging steel is preferably held to a content of 0.4% or less. Since Mo is a bcc stabilizing element, however, it can be effectively utilized in a steel to be forged at high temperature. But when added to a content in excess of 1.5%, Mo sharply increases deformation resistance at high-temperature. The upper limit of Mo addition is therefore defined as 1.5%.

Addition of Ni produces mainly two effects. One is in the role Ni plays in increasing Di and controlling the structure of the steel. However, when other elements such as Si, Mn and Cr can fill this role, there is no particular need to add Ni. The other is the effect of Ni addition toward improving toughness, which is necessary in steel components such as slow-speed gears. When used for this purpose, Ni is preferably added to a content of 0.4% or greater. On the other hand, Ni impairs carburizability when added to a content exceeding 4.5%. The range of Ni content is therefore defined as 4.5% or less. Ni is an fcc stabilizing element. Therefore, addition of a bcc stabilizing element simultaneously with Ni is effective for reducing deformation resistance in the high-temperature zone.

Al: 0.0001 to 2.0%

Al addition is directed mainly to three purposes. The first is to utilize AlN. Occurrence of coarse grains during carburization can be prevented by exploiting the ability of AlN precipitates to pin grain boundary movement. At an Al content of less than 0.0001%, this effect is not exhibited because the amount of AlN precipitates is insufficient. Al must therefore be added to a content of 0.0001% or greater. The second purpose is to utilize Al as a bcc stabilizing element in a steel for forging in the high-temperature zone. Deformation resistance during forging in the high-temperature zone can be lowered by increasing bcc fraction. The third purpose is to impart hardenability to the steel. Di can be increased by Al addition. Addition of Al to a content exceeding 2.0% impairs carburizability. The Al content range is therefore defined as 0.0001 to 2.0%, more preferably 0.001 to 2.0%. Addition of Al to a content of greater than 0.06% to 2.0% increases bcc fraction, thereby effectively reducing deformation resistance in the warm and hot forging zones.

Cu: 0.6 to 2.0%

Addition of Cu produces mainly three effects. One is in the role Cu plays in improving the corrosion resistance of the steel. The second is the toughness and fatigue strength improving activity of Cu, which works to good effect when Cu is added to low-speed gear steel. These two effects are small when Cu is added to a content of less than 0.6%. The lower limit of Cu content is therefore defined as 0.6%. The third effect is to impart hardenability to the steel, which is exhibited at a Cu content of greater than 1%. Addition of Cu to a content exceeding 2% heavily degrades the hot-ductility of the steel and leads to occurrence of many flaws during rolling. The range of Cu content is therefore defined as 0.6 to 2.0%. As Cu increases deformation resistance at room temperature, its content in a cold-forging steel is therefore preferably held to 1.5% or less. Moreover, Cu is an fcc stabilizing element. Therefore, in order to reduce deformation resistance in the high-temperature zone, it is effective to add a bcc stabilizing element simultaneously.

B: not less than BL given by Equation (7) below and not greater than 0.008% and Ti: 0.15% or less, (including 0%)

$$BL=0.0004+10.8/14\times([\%\ N]-14/47.9\times[\%\ Ti]) \quad (7),$$

where ([% N]−14/47.9×[% Ti]) of less than 0 is treated as 0, a symbol in brackets [ ] indicating content (mass %) of the element concerned B is a useful element that increases steel Di without significantly increasing deformation resistance. For promoting hardenability, solute B content of 0.0004% or greater necessary. However, owing to the strong affinity between B and N, added B readily combines with solute N to form BN, thus reducing solute B and making it impossible to ensure hardenability. Therefore, since B content=(solute B content+B contained in BN), the lower limit of B content for ensuring required solute B content becomes the amount of solute B plus the amount of B that forms BN. The atomic weight of B is 10.8 and that of N is 14, so the amount of B that forms BN is 10.8/14×N.

Moreover, N has stronger affinity for Ti than B. Therefore, if Ti is added, TiN is formed first and the amount of B forming BN decreases. As the atomic weight of N is 14 and that of Ti is 47.9, the amount of N remaining after TiN formation is (N−14/47.9×Ti) and this remaining N forms BN. From this it follows that a B content equal to or greater than BL determined by Equation (7) is required to ensure solute B of 0.0004% or greater. However, as explained further later, if Ti is added in an amount greater than that consumed for TiN formation aimed at securing the desired solute B content, the excess amount does not contribute to TiN formation. Therefore, when ([% N]−14/47.9×[% Ti]) is less than 0, it is treated as 0.

Defining the lower limit of B content in this way makes it possible to ensure a solute B content of 0.0004% or greater and thereby achieve adequate hardenability.

When the content of B exceeds 0.008%, its effect saturates and manufacturability is impaired. The upper limit of B content is therefore defined as 0.008%.

As explained earlier, Ti forms TiN when added. However, when N content is sufficiently low and B is added to a content that ensures adequate solute B, there is no need to add Ti for the purpose of TiN formation aimed at ensuring required solute B content.

However, TiN has an effect of inhibiting crystal grain coarsening. Moreover, Ti present in excess of 47.9/14×N forms TiC, which, like TiN, inhibits grain boundary movement. Ti addition is effective when coarse grains tend to occur owing to high carburization temperature or the like. In order to use formed Ti carbonitrides to prevent grain boundary movement, Ti should preferably be added to a content of 0.005% or greater. When Ti content exceeds 0.15%, coarse Ti carbonitrides occur that act as starting points for fatigue fracture. The upper limit of Ti content is therefore defined as 0.15%.

When B is added, Di is determined using the following Equations (3) and (4), which are obtained by multiplying the right sides of Equations (1) and (2) by 1.976, a factor based on an evaluation of the effect of B addition on Di.

$$Di=5.41\times Di(\mathrm{Si})\times Di(\mathrm{Mn})\times Di(\mathrm{Cr})\times Di(\mathrm{Mo})\times Di(\mathrm{Ni})\times Di(\mathrm{Al})\times 1.976 \quad (3)$$

$$Di=5.41\times Di(\mathrm{Si})\times Di(\mathrm{Mn})\times Di(\mathrm{Cr})\times Di(\mathrm{Mo})\times Di(\mathrm{Ni})\times Di(\mathrm{Al})\times Di(\mathrm{Cu})\times 1.976 \quad (4).$$

In formulating Equations (3) and (4), the following experiment was carried out to determine the contribution of B with respect to Equations (1) and (2).

Specifically, numerous ingots of compositions controlled to the following component ranges were produced and rolled into steel materials: fixed C content of 0.4%, Cr: 0 to 5.0%, Si: 0 to 3.0%, Mn: 0.01 to 4.0%, Mo: 0 to 1.5%, Ni: 0 to 4.5%, S: 0.35% or less, Al: 0.0001 to 2.0%, P: 0.2% or less, N: 0.03% or less, Cu: 0 to 2.0%, B: 0 to 0.007%, and the balance of Fe an unavoidable impurities. Test pieces of rolled steels of the aforesaid different compositions prepared in the shape specified by JIS G 0561 (2000) were hardenability tested by hardening from the austenite region temperature. The data obtained from the tests were analyzed for the difference in hardenability between 0.4% C steels containing and not containing added B, and Di was determined by the method set out in the aforesaid general literature reference *Yakiiresei* by Shigeo Owaku. The average value of the effects of B on hardenability was found to be 1.976. Equations (3) and (4) were obtained by multiplying the right sides of Equations (1) and (2) by this value.

One or both of Nb: 0.005 to 0.1% and V: 0.01 to 0.5%

Heat treatment of a component after forging, cutting or other machining may cause grain coarsening if the heat treatment temperature is high. In such case, the component may deform or experience some other problem because the grain-coarsened region has a different structure from its surroundings. When heat treatment distortion must be strictly controlled, grain coarsening must be prevented. The ability of Nb carbonitride and V carbonitride to pin grain boundary movement can be effectively utilized for this purpose.

In order to use formed Nb carbonitrides to prevent grain boundary movement, Nb must be added to a content of 0.005% or greater. On the other hand, deformation resistance increases sharply when Nb content exceeds 0.1%. The upper limit of Nb content is therefore defined as 0.1%, so that the range of Nb content is defined as 0.005 to 0.1%.

In order to use formed V carbonitrides to prevent grain boundary movement, V must be added to a content of 0.01% or greater. On the other hand, addition of V in excess of 0.5% causes occurrence of flaws during rolling. The upper limit of V content is therefore defined as 0.5%, so that the range of V content is defined as 0.01 to 0.5%.

One or more of Mg: 0.0002 to 0.003%, Te: 0.0002 to 0.003%, Ca: 0.0003 to 0.003%, Zr: 0.0003 to 0.005%, and REM: 0.0003 to 0.005%.

Elongated MnS inclusions present in the steel component are disadvantageous in that they impart anisotropy to the component's mechanical properties and act as starting points for metal fatigue fracture. Some components require very high fatigue strength. One or more of Mg, Te, Ca, Zr and REM are added to such components to control the MnS morphology. However, the amounts added are limited to specified ranges for the following reasons.

The minimum Mg content for controlling MnS morphology is 0.0002%. But an Mg content of greater than 0.003% coarsens oxides and degrades rather than improves fatigue strength. The range of Mg content is therefore defined as 0.0002 to 0.003%.

The minimum Te content for controlling MnS morphology is 0.0002%. But a Te content of greater than 0.003% greatly strengthens hot embrittlement to make the steel hard to process during manufacture. The range of Te content is therefore defined as 0.0002 to 0.003%.

The minimum Ca content for controlling MnS morphology is 0.0003%. But a Ca content of greater than 0.003% coarsens oxides and degrades rather than improves fatigue strength. The range of Ca content is therefore defined as 0.0003 to 0.003%.

The minimum Zr content for controlling MnS morphology is 0.0003%. But a Zr content of greater than 0.005% coarsens oxides and degrades rather than improves fatigue strength. The range of Zr content is therefore defined as 0.0003 to 0.005%.

The minimum REM content for controlling MnS morphology is 0.0003% But an REM content of greater than 0.005% coarsens oxides and degrades rather than improves fatigue strength. The range of REM content is therefore defined as 0.0003 to 0.005%.

When the invention steel is heat treated following forging, cutting and/or other machining, there can be used any of various surface hardening processes, including gas carburizing, vacuum carburizing, high carbon carburizing, and carbonitriding. Moreover, high-frequency induction heating hardening can be conducted after and in combination with these processes.

The invention steel offers excellent forging performance that enables reduction of deformation resistance in cold forging, warm forging and hot forging. As such, it is a steel that enables production of components by combining two or more of these processes.

The present invention is explained in further detail below with reference to working examples. However, the present invention is in no way limited to the following examples and it should be understood that appropriate modifications can be made without departing from the gist of the present invention and that all such modifications fall within technical scope of the present invention.

EXAMPLES

First Set of Examples

Cold forging examples will be explained first. Rolled billets of steels produced to have the chemical compositions shown in Table 1 were heated to 1,150° C., hot rolled, and finish rolled at 930° C. to fabricate 50 mm-diameter steel bars.

TABLE 1

| Test No | Steel components (mass %) C | Si | Mn | P | S | Cr | Mo | Ni | Cu | Al | N | BL |
|---|---|---|---|---|---|---|---|---|---|---|---|---|
| 1 | 0.200 | 0.25 | 0.65 | 0.013 | 0.011 | 0.92 | — | — | — | 0.033 | 0.013 | — |
| 2 | 0.202 | 0.25 | 0.75 | 0.018 | 0.020 | 0.55 | 0.21 | 0.55 | — | 0.032 | 0.012 | — |
| 3 | 0.199 | 0.27 | 0.79 | 0.014 | 0.020 | 1.08 | 0.20 | — | — | 0.025 | 0.012 | — |
| 4 | 0.150 | 0.26 | 0.44 | 0.012 | 0.014 | 0.87 | 0.25 | 4.2 | — | 0.036 | 0.013 | — |
| 5 | 0.014 | 0.05 | 0.55 | 0.008 | 0.015 | 1.13 | 0.04 | — | — | 0.032 | 0.010 | — |
| 6 | 0.011 | 0.01 | 0.47 | 0.007 | 0.019 | 1.60 | 0.04 | — | — | 0.041 | 0.015 | — |
| 7 | 0.012 | 0.02 | 0.25 | 0.011 | 0.011 | 1.20 | — | — | — | 0.025 | 0.004 | 0.0004 |
| 8 | 0.005 | 0.20 | 0.70 | 0.021 | 0.035 | 1.22 | — | — | — | 0.035 | 0.012 | — |
| 9 | 0.007 | 0.01 | 0.55 | 0.006 | 0.015 | 1.70 | 0.04 | — | — | 0.029 | 0.012 | — |
| 10 | 0.008 | 0.01 | 0.30 | 0.008 | 0.012 | 1.00 | — | 0.66 | 1.20 | 0.100 | 0.004 | — |
| 11 | 0.007 | 0.02 | 0.60 | 0.012 | 0.014 | 1.72 | 0.04 | — | — | 0.033 | 0.005 | — |
| 12 | 0.010 | 0.20 | 0.54 | 0.009 | 0.018 | 1.90 | — | — | — | 0.033 | 0.006 | — |
| 13 | 0.007 | 0.04 | 0.25 | 0.007 | 0.009 | 1.59 | — | — | — | 0.038 | 0.002 | 0.0004 |
| 14 | 0.061 | 0.01 | 0.30 | 0.011 | 0.014 | 1.55 | — | — | — | 0.019 | 0.005 | 0.0004 |
| 15 | 0.021 | 0.01 | 0.26 | 0.009 | 0.018 | 1.10 | — | — | — | 0.110 | 0.004 | 0.0004 |
| 16 | 0.014 | 0.05 | 0.28 | 0.011 | 0.016 | 1.61 | — | — | — | 0.041 | 0.004 | 0.0004 |
| 17 | 0.007 | 0.01 | 0.25 | 0.008 | 0.008 | 0.60 | — | 0.57 | 1.02 | 0.041 | 0.004 | 0.0004 |
| 18 | 0.014 | 0.05 | 0.40 | 0.009 | 0.051 | 1.90 | — | — | — | 0.130 | 0.004 | — |
| 19 | 0.006 | 0.50 | 0.23 | 0.013 | 0.003 | 1.45 | — | — | — | 0.021 | 0.004 | 0.0004 |
| 20 | 0.015 | 0.03 | 0.29 | 0.008 | 0.004 | 1.72 | — | — | — | 0.034 | 0.004 | 0.0004 |
| 21 | 0.013 | 0.50 | 0.30 | 0.008 | 0.010 | 1.60 | 0.21 | 0.55 | — | 0.038 | 0.013 | — |
| 22 | 0.008 | 0.01 | 0.24 | 0.014 | 0.015 | 1.50 | 0.20 | — | — | 0.029 | 0.003 | 0.0004 |
| 23 | 0.009 | 0.02 | 0.26 | 0.008 | 0.009 | 1.00 | — | 0.71 | 1.31 | 0.130 | 0.004 | 0.0004 |
| 24 | 0.013 | 0.31 | 0.95 | 0.014 | 0.012 | 1.40 | — | — | — | 0.045 | 0.005 | 0.0043 |
| 25 | 0.012 | 0.40 | 0.94 | 0.015 | 0.015 | 1.57 | — | — | — | 0.041 | 0.002 | 0.0004 |
| 26 | 0.011 | 0.03 | 0.30 | 0.010 | 0.010 | 0.88 | 0.25 | 4.2 | — | 0.041 | 0.004 | 0.0004 |
| 27 | 0.010 | 0.38 | 0.70 | 0.010 | 0.014 | 2.50 | 0.05 | — | — | 0.030 | 0.003 | 0.0004 |
| 28 | 0.012 | 0.02 | 0.25 | 0.012 | 0.014 | 0.50 | — | — | — | 0.028 | 0.003 | 0.0004 |
| 29 | 0.013 | 0.05 | 0.32 | 0.015 | 0.015 | 0.47 | — | — | — | 0.033 | 0.004 | 0.0004 |
| 30 | 0.014 | 0.10 | 0.29 | 0.012 | 0.014 | 0.54 | — | — | — | 0.035 | 0.004 | 0.0004 |
| 31 | 0.012 | 0.10 | 0.50 | 0.011 | 0.013 | 0.92 | 0.04 | — | — | 0.033 | 0.007 | — |
| 32 | 0.012 | 0.04 | 0.31 | 0.009 | 0.015 | 0.66 | — | — | — | 0.026 | 0.004 | 0.0004 |
| 33 | 0.035 | 3.20 | 1.30 | 0.020 | 0.021 | 1.70 | — | — | — | 0.042 | 0.010 | — |
| 34 | 0.081 | 0.50 | 0.70 | 0.016 | 0.010 | 1.50 | — | — | — | 0.029 | 0.011 | — |
| 35 | 0.010 | 0.02 | 4.50 | 0.012 | 0.013 | 1.50 | — | — | — | 0.041 | 0.013 | — |
| 36 | 0.012 | 0.03 | 0.40 | 0.250 | 0.014 | 1.42 | — | — | — | 0.035 | 0.003 | 0.0004 |
| 37 | 0.011 | 0.05 | 0.36 | 0.015 | 0.380 | 1.33 | — | — | — | 0.029 | 0.003 | 0.0004 |
| 38 | 0.009 | 0.02 | 0.28 | 0.011 | 0.015 | 5.60 | — | — | — | 0.036 | 0.014 | — |
| 39 | 0.008 | 0.06 | 0.31 | 0.015 | 0.016 | 1.40 | — | — | — | 2.100 | 0.012 | — |
| 40 | 0.011 | 0.20 | 0.35 | 0.011 | 0.017 | 1.80 | — | — | — | 0.045 | 0.035 | — |

| Test No | B | Ti | Nb | V | Other elements | Di | Type |
|---|---|---|---|---|---|---|---|
| 1 | — | — | — | — | — | 60 | Comparative |
| 2 | — | — | — | — | — | 95 | Comparative |
| 3 | — | — | — | — | — | 125 | Comparative |
| 4 | — | — | — | — | — | 191 | Comparative |
| 5 | — | — | — | — | — | 64 | Invention |
| 6 | — | — | — | — | — | 70 | Invention |
| 7 | 0.0010 | 0.023 | — | — | — | 71 | Invention |
| 8 | — | — | — | — | — | 75 | Invention |
| 9 | — | — | — | 0.11 | — | 81 | Invention |
| 10 | — | — | — | — | — | 86 | Invention |
| 11 | — | 0.023 | — | — | — | 87 | Invention |
| 12 | — | 0.025 | — | — | Zr: 0.0001 | 88 | Invention |
| 13 | 0.0019 | 0.018 | — | — | — | 89 | Invention |
| 14 | 0.0015 | 0.023 | — | — | Ca: 0.0008 | 94 | Invention |

TABLE 1-continued

| | Steel components (mass %) | | | | | | |
|---|---|---|---|---|---|---|---|
| 15 | 0.0021 | 0.025 | — | — | — | 95 | Invention |
| 16 | 0.0023 | 0.024 | — | — | REM: 0.0014 | 96 | Invention |
| 17 | 0.0020 | 0.023 | — | — | — | 99 | Invention |
| 18 | — | — | — | — | — | 101 | Invention |
| 19 | 0.0016 | 0.022 | — | — | Te: 0.001 | 105 | Invention |
| 20 | 0.0017 | 0.025 | 0.011 | — | Mg: 0.0009<br>REM::0.002 | 101 | Invention |
| 21 | — | — | — | — | — | 127 | Invention |
| 22 | 0.0018 | 0.027 | — | — | — | 131 | Invention |
| 23 | 0.0022 | 0.026 | — | — | — | 143 | Invention |
| 24 | 0.0074 | — | — | — | — | 218 | Invention |
| 25 | 0.0015 | 0.019 | — | — | — | 248 | Invention |
| 26 | 0.0016 | 0.026 | — | — | — | 267 | Invention |
| 27 | 0.0016 | 0.020 | — | — | — | 332 | Invention |
| 28 | 0.0020 | 0.026 | — | — | — | 41 | Comparative |
| 29 | 0.0022 | 0.023 | — | — | — | 46 | Comparative |
| 30 | 0.0021 | 0.023 | — | — | — | 49 | Comparative |
| 31 | — | — | — | — | — | 52 | Comparative |
| 32 | 0.0023 | 0.029 | — | — | — | 54 | Comparative |
| 33 | — | — | — | — | — | 451 | Comparative |
| 34 | — | — | — | — | — | 103 | Comparative |
| 35 | — | — | — | — | — | 507 | Comparative |
| 36 | 0.0022 | 0.024 | — | — | — | 103 | Comparative |
| 37 | 0.0015 | 0.024 | — | — | — | 94 | Comparative |
| 38 | — | — | — | — | — | 139 | Comparative |
| 39 | — | — | — | — | — | 433 | Comparative |
| 40 | — | — | — | — | — | 55 | Comparative |

Samples cut from the steel bars of Table 1 and ground into cylindrical test pieces of 14 mm diameter by 21 mm length were subjected to compression testing at a strain rate of 10/s at room temperature. The maximum flow stress up to equivalent strain of 0.5 was investigated.

Samples cut from the steel bars and ground into cylindrical test pieces of 17.5 mm diameter by 52.5 mm length were subjected to heat treatment combining gas carburization/quenching, vacuum carburization/quenching, or carbonitriding/quenching with ensuing high-frequency induction heating. The gas carburization was conducted at 950° C. under carbon potential of 1.1% for 176 min and then carbon potential of 0.8% for 110 min, followed by quenching and tempering at 160° C. In addition, heat treatment was also conducted at the level of long-duration gas carburization at 950° C. under carbon potential of 1.1% for 234 min and then carbon potential of 0.8% for 146 min, followed by quenching and tempering at 160° C. Carbonitriding was conducted by carburization at 940° C., carbon potential of 0.8%, and then nitriding by lowering the temperature of the same furnace to 840° C. and adding $NH_3$ to a concentration of 7%, followed by quenching. The high-frequency induction heating was done at 900° C., followed by water quenching. All tempering was conducted at 160° C. Next, the test piece was cut crosswise, the cross-sectional surface was polished, and the HV hardness distribution in the cross-section was measured inward from the test piece surface under 200 g load using a micro Vickers hardness tester, thereby determining the effective hardening depth The results of the foregoing study are shown in Table 2. The bcc fractions (%) and the deformation resistance (MPa) at room temperature are also shown in Table 2. The bcc fractions were calculated by computer from the components (%) shown in Table 1 and the deformation temperature (room temperature) shown in Table 2 using the Thermo-Calc program available from Thermo-Calc Software.

TABLE 2

| Test No | bcc fraction at room temperature (%) | Deformation resistance at room temperature (MPa) | Heat treatment | Effective hardening depth (mm) | Type |
|---|---|---|---|---|---|
| 1 | 100 | 715 | Gas carburization→Quenching→Tempering | 0.88 | Comparative |
| 2 | 100 | 750 | Gas carburization→Quenching→Tempering | 0.88 | Comparative |
| 3 | 100 | 741 | Gas carburization→Quenching→Tempering | 0.88 | Comparative |
| 4 | 100 | 800 | Gas carburization→Quenching→Tempering | 0.86 | Comparative |
| 5 | 100 | 428 | Gas carburization→Quenching→Tempering | 0.76 | Invention |
| 6 | 100 | 432 | Long-duration gas carburization→Quenching→Tempering | 0.88 | Invention |
| 7 | 100 | 445 | Gas carburization→Quenching→Tempering | 0.74 | Invention |
| 8 | 100 | 490 | Gas carburization→Quenching→Tempering | 0.80 | Invention |
| 9 | 100 | 445 | Gas carburization→Quenching→Tempering | 0.78 | Invention |
| 10 | 100 | 563 | Gas carburization→Quenching→Tempering | 0.84 | Invention |
| 11 | 100 | 472 | Carbonitriding→High-frequency heating→Quenching→Tempering | 0.88 | Invention |
| 12 | 100 | 471 | Gas carburization→Quenching→Tempering | 0.78 | Invention |
| 13 | 100 | 450 | Gas carburization→Quenching→Tempering | 0.78 | Invention |
| 14 | 100 | 500 | Gas carburization→Quenching→Tempering | 0.79 | Invention |
| 15 | 100 | 471 | Gas carburization→Quenching→Tempering | 0.84 | Invention |

TABLE 2-continued

| Test No | bcc fraction at room temperature (%) | Deformation resistance at room temperature (MPa) | Heat treatment | Effective hardening depth (mm) | Type |
|---|---|---|---|---|---|
| 16 | 100 | 456 | Gas carburization→Quenching→Tempering | 0.78 | Invention |
| 17 | 100 | 551 | Gas carburization→Quenching→Tempering | 0.78 | Invention |
| 18 | 100 | 475 | Gas carburization→Quenching→Tempering | 0.81 | Invention |
| 19 | 100 | 429 | Gas carburization→High-frequency heating→Quenching→Tempering | 0.88 | Invention |
| 20 | 100 | 460 | Gas carburization→Quenching→Tempering | 0.79 | Invention |
| 21 | 100 | 541 | Gas carburization→Quenching→Tempering | 0.80 | Invention |
| 22 | 100 | 501 | Gas carburization→Quenching→Tempering | 0.80 | Invention |
| 23 | 100 | 462 | Gas carburization→Quenching→Tempering | 0.79 | Invention |
| 24 | 100 | 550 | Gas carburization→Quenching→Tempering | 0.82 | Invention |
| 25 | 100 | 552 | Gas carburization→Quenching→Tempering | 0.84 | Invention |
| 26 | 100 | 502 | Gas carburization→Quenching→Tempering | 0.78 | Invention |
| 27 | 100 | 554 | Gas carburization→Quenching→Tempering | 0.88 | Invention |
| 28 | 100 | 431 | Gas carburization→Quenching→Tempering | 0 | Comparative |
| 29 | 100 | 419 | Gas carburization→Quenching→Tempering | 0 | Comparative |
| 30 | 100 | 415 | Gas carburization→Quenching→Tempering | 0 | Comparative |
| 31 | 100 | 418 | Gas carburization→Quenching→Tempering | 0.46 | Comparative |
| 32 | 100 | 420 | Gas carburization→Quenching→Tempering | 0.47 | Comparative |
| 33 | 100 | 654 | Gas carburization→Quenching→Tempering | 0.30 | Comparative |
| 34 | 100 | 670 | Gas carburization→Quenching→Tempering | 0.78 | Comparative |
| 35 | 100 | 721 | Gas carburization→Quenching→Tempering | 0.88 | Comparative |
| 36 | 100 | | Not producible owing to cracking during rolling | | Comparative |
| 37 | 100 | | Not producible owing to cracking during rolling | | Comparative |
| 38 | 100 | 560 | Gas carburization→Quenching→Tempering | 0.36 | Comparative |
| 39 | 100 | 510 | Gas carburization→Quenching→Tempering | 0.38 | Comparative |
| 40 | 100 | | Not producible owing to cracking during rolling | | Comparative |

The steel used in Test No. 1 was a JIS SCr420 comparative steel with a C content of 0.2% and a Di of 60. The invention steels used in Test No. 5 to Test No. 27 were this steel lowered in deformation resistance during cold forging. The invention steels of Test No. 5 to Test No. 27 were all greatly reduced in deformation resistance The effective hardening depths of the invention steels with low Di values were about 85% that of the Test No. 1 steel and were in all cases 0.6 mm or greater, while effective hardening depth of the invention steel of Test No. 27, which had a high Di, was 0.88 mm, comparable to that of Test No. 1 steel. Moreover, the steel of Test No. 11, which was subjected to carbonitriding→high-frequency heating→quenching→tempering, and the steel of Test No. 19, which was subjected to gas carburization→high-frequency heating→quenching→tempering, and the steel of Test No. 6, which was subjected to long-duration gas carburization→quenching→tempering, had comparable effective hardening depths despite being low in Di.

The steel used in Test No. 2 was a JIS SNCM220 comparative steel with a C content of 0.2% and a Di of 95. Where deformation resistance is to be reduced while maintaining this Di, the invention steels used in Test No. 15 to Test No. 27 are suitable. When the hardened component is small, it is of course possible to utilize any of the steels used in Test No. 5 to Test No. 27.

The steel used in Test No. 3 was a JIS SCM420 comparative steel with a C content of 0.2% and a Di of 125. Where the steel is to be soften while maintaining this Di, the invention steels used in Test No. 21 to Test No. 27 are suitable. When the hardened component is small, it is of course possible to utilize any of the steels used in Test No. 5 to Test No. 27.

The steel used in Test No. 4 was a JIS SNCM815 comparative steel with a C content of 0.15% and a Di of 191. Where the steel is to be soften while maintaining this Di, the invention steels used in Test No. 24 to Test No. 27 are suitable. When the hardened component is small, it is of course possible to utilize any of the steels used in Test No. 5 to Test No. 27.

A steel with a large Di is generally used for a large component. In the case of the invention steels, it is similarly possible to use an invention steel with a large Di for a large component.

Moreover, Di is not the only factor determining the properties of a steel and, for example, toughness may be enhanced by adding Ni. In such a case, Di is maintained by adding Ni to a content within the range defined by the invention chemical composition.

The steel used in Test No. 28 had a Di below the invention range. Since its hardenability was therefore insufficient, it achieved a hardness after carburization, quenching/hardening and tempering of only about Hv 400 even at the outermost surface layer. As a result, its effective hardening depth, i.e., depth to the portion having a hardness of Hv 550, was 0 mm. The steels of Test No. 29 and Test No. 30 had Di values below the invention range. Since their hardenabilities were therefore insufficient, they achieved hardnesses after carburization, quenching/hardening and tempering of only about Hv 500 even at the outermost surface layer. As a result, their effective hardening depths, i.e., depths to the portion having a hardness of Hv 550, was 0 mm. The steels of Test No. 31 and Test No. 32 had Di values below the invention range. Since their hardenabilities were therefore insufficient, they had insufficient effective hardening depths after carburization, quenching/hardening and tempering. The steel of Test No. 33 had an Si content above the invention range. Since its carburizability was therefore inferior, no effective hardened layer was obtained. The steel of Test No. 34 had a C content above the invention range and was therefore high in deformation resistance.

The steel of Test No. 35 had an Mn content above the invention range and was therefore high in deformation resistance. The steel of Test No. 36 had a P content above the invention range and therefore experienced cracking that made production impossible. The steel of Test No. 37 had an S content above the invention range. It therefore experienced hot embrittlement and resultant cracking that made production impossible. The steel of Test No. 38 had a Cr content above the invention range. Since its carburizability was therefore inferior, no effective hardened layer was obtained. The steel of Test No. 39 had an Al content above the invention range. Since its carburizability was therefore inferior, no effective hardened layer was obtained. The steel of Test No. 40 had an N content above the invention range and therefore experienced cracking that made production impossible.

Second Set of Examples

Warm and hot forging examples will be explained first Rolled billets of steels produced to have the chemical compositions shown in Table 3 were heated to 1,150° C., hot rolled, and finish rolled at 930° C. to fabricate 50 mm-diameter steel bars.

TABLE 3

| | Steel components (mass %) | | | | | | | | | | | |
|---|---|---|---|---|---|---|---|---|---|---|---|---|
| Test No | C | Si | Mn | P | S | Cr | Mo | Ni | Cu | Al | N | BL |
| 41 | 0.201 | 0.28 | 0.65 | 0.011 | 0.015 | 0.92 | — | — | — | 0.030 | 0.012 | — |
| 42 | 0.200 | 0.25 | 0.65 | 0.013 | 0.015 | 0.92 | — | — | — | 0.033 | 0.013 | — |
| 43 | 0.199 | 0.28 | 0.65 | 0.008 | 0.019 | 0.92 | — | — | — | 0.034 | 0.010 | — |
| 44 | 0.204 | 0.28 | 0.65 | 0.009 | 0.013 | 0.92 | — | — | — | 0.032 | 0.011 | — |
| 45 | 0.203 | 0.25 | 0.80 | 0.019 | 0.020 | 0.50 | 0.20 | 0.55 | — | 0.033 | 0.014 | — |
| 46 | 0.202 | 0.25 | 0.75 | 0.018 | 0.014 | 0.55 | 0.21 | 0.55 | — | 0.032 | 0.012 | — |
| 47 | 0.203 | 0.10 | 1.24 | 0.020 | 0.024 | 1.15 | — | — | — | 0.039 | 0.014 | — |
| 48 | 0.203 | 0.27 | 0.79 | 0.014 | 0.015 | 1.08 | 0.20 | — | — | 0.025 | 0.012 | — |
| 49 | 0.150 | 0.26 | 0.44 | 0.009 | 0.013 | 0.87 | 0.25 | 4.2 | — | 0.036 | 0.013 | — |
| 50 | 0.004 | 0.05 | 0.55 | 0.008 | 0.011 | 1.13 | 0.04 | — | — | 0.032 | 0.011 | — |
| 51 | 0.011 | 0.01 | 0.47 | 0.007 | 0.011 | 1.60 | 0.04 | — | — | 0.041 | 0.015 | — |
| 52 | 0.012 | 0.02 | 0.30 | 0.011 | 0.014 | 1.06 | — | — | — | 0.025 | 0.004 | 0.0004 |
| 53 | 0.005 | 0.20 | 0.70 | 0.021 | 0.031 | 1.22 | — | — | — | 0.035 | 0.012 | — |
| 54 | 0.007 | 0.01 | 0.55 | 0.006 | 0.003 | 1.70 | 0.04 | — | — | 0.029 | 0.013 | — |
| 55 | 0.040 | 0.04 | 0.26 | 0.015 | 0.011 | 1.44 | — | — | — | 0.042 | 0.004 | 0.0004 |
| 56 | 0.007 | 0.02 | 0.60 | 0.012 | 0.015 | 1.72 | 0.04 | — | — | 0.033 | 0.005 | — |
| 57 | 0.013 | 0.20 | 0.25 | 0.015 | 0.012 | 3.10 | — | — | — | 0.035 | 0.014 | — |
| 58 | 0.010 | 0.20 | 0.54 | 0.009 | 0.014 | 1.90 | — | — | — | 0.033 | 0.006 | — |
| 59 | 0.007 | 0.04 | 0.25 | 0.007 | 0.009 | 1.59 | — | — | — | 0.038 | 0.002 | 0.0004 |
| 60 | 0.012 | 0.05 | 0.30 | 0.150 | 0.014 | 1.50 | — | — | — | 0.035 | 0.004 | 0.0004 |
| 61 | 0.014 | 0.05 | 0.28 | 0.011 | 0.014 | 1.61 | — | — | — | 0.041 | 0.004 | 0.0004 |
| 62 | 0.011 | 0.03 | 0.32 | 0.011 | 0.016 | 1.50 | — | — | — | 0.040 | 0.004 | 0.0004 |
| 63 | 0.012 | 0.01 | 0.35 | 0.012 | 0.015 | 1.44 | — | — | — | 0.040 | 0.002 | 0.0004 |
| 64 | 0.050 | 0.30 | 0.30 | 0.011 | 0.004 | 1.30 | — | — | — | 0.042 | 0.005 | 0.0004 |
| 65 | 0.015 | 0.03 | 0.29 | 0.008 | 0.016 | 1.72 | — | — | — | 0.034 | 0.004 | 0.0004 |
| 66 | 0.006 | 0.50 | 0.23 | 0.013 | 0.018 | 1.45 | — | — | — | 0.021 | 0.004 | 0.0004 |
| 67 | 0.009 | 0.08 | 0.25 | 0.014 | 0.016 | 2.00 | — | — | — | 0.034 | 0.004 | 0.0004 |
| 68 | 0.012 | 0.02 | 0.30 | 0.011 | 0.016 | 0.50 | 0.50 | — | — | 0.033 | 0.006 | 0.0050 |
| 69 | 0.012 | 0.40 | 0.21 | 0.014 | 0.009 | 0.73 | 0.21 | 0.55 | — | 0.033 | 0.004 | 0.0004 |
| 70 | 0.010 | 0.03 | 0.31 | 0.012 | 0.015 | — | 1.50 | — | — | 0.029 | 0.004 | 0.0004 |
| 71 | 0.010 | 0.03 | 0.28 | 0.012 | 0.010 | 1.35 | — | — | — | 0.500 | 0.004 | — |
| 72 | 0.013 | 0.50 | 0.30 | 0.008 | 0.010 | 1.60 | 0.21 | 0.55 | — | 0.038 | 0.013 | — |
| 73 | 0.011 | 0.80 | 0.26 | 0.008 | 0.014 | 1.44 | — | — | — | 0.033 | 0.004 | 0.0004 |
| 74 | 0.009 | 0.06 | 0.26 | 0.011 | 0.011 | 2.50 | — | — | — | 0.036 | 0.003 | 0.0004 |
| 75 | 0.020 | 0.01 | 0.24 | 0.014 | 0.015 | 1.50 | 0.20 | — | — | 0.250 | 0.010 | — |
| 76 | 0.010 | 0.10 | 0.25 | 0.009 | 0.010 | 3.10 | — | — | — | 0.045 | 0.004 | 0.0004 |
| 77 | 0.012 | 0.10 | 0.26 | 0.008 | 0.013 | 4.10 | — | — | — | 0.130 | 0.003 | — |
| 78 | 0.011 | 1.30 | 0.26 | 0.012 | 0.011 | 1.55 | — | — | — | 0.033 | 0.003 | 0.0004 |
| 79 | 0.010 | 0.30 | 0.40 | 0.012 | 0.014 | 1.80 | — | 0.32 | 0.60 | 0.042 | 0.004 | 0.0004 |
| 80 | 0.013 | 0.50 | 0.24 | 0.010 | 0.010 | 1.60 | 0.30 | — | — | 0.040 | 0.004 | 0.0004 |
| 81 | 0.011 | 0.20 | 0.95 | 0.010 | 0.051 | 1.00 | — | — | — | 0.102 | 0.003 | 0.0004 |
| 82 | 0.013 | 0.04 | 0.26 | 0.011 | 0.013 | 1.30 | — | — | — | 0.500 | 0.004 | 0.0004 |
| 83 | 0.009 | 0.38 | 0.90 | 0.017 | 0.017 | 1.61 | — | — | — | 0.036 | 0.005 | 0.0043 |
| 84 | 0.011 | 0.05 | 0.30 | 0.014 | 0.016 | 1.40 | — | — | — | 1.100 | 0.013 | — |
| 85 | 0.012 | 0.40 | 0.94 | 0.015 | 0.011 | 1.57 | — | — | — | 0.041 | 0.002 | 0.0004 |
| 86 | 0.011 | 0.21 | 0.97 | 0.010 | 0.200 | 1.10 | — | — | — | 0.110 | 0.003 | 0.0004 |
| 87 | 0.010 | 0.40 | 0.93 | 0.010 | 0.015 | 1.60 | 0.34 | — | — | 0.030 | 0.013 | — |
| 88 | 0.030 | 0.02 | 0.32 | 0.011 | 0.014 | 1.50 | — | — | — | 0.500 | 0.004 | 0.0004 |
| 89 | 0.003 | 0.50 | 0.26 | 0.012 | 0.012 | 1.00 | — | — | — | 1.490 | 0.012 | — |
| 90 | 0.009 | — | 0.31 | 0.015 | 0.017 | 1.39 | — | — | — | 1.500 | 0.012 | — |
| 91 | 0.009 | 0.21 | 0.33 | 0.012 | 0.015 | 1.50 | — | 0.72 | 1.15 | 0.150 | 0.004 | 0.0004 |
| 92 | 0.005 | 0.20 | 0.39 | 0.016 | 0.017 | 1.00 | — | — | — | 1.500 | 0.012 | — |
| 93 | 0.009 | 0.01 | 0.25 | 0.010 | 0.015 | 1.38 | — | — | — | 1.490 | 0.003 | 0.0004 |
| 94 | 0.010 | 0.06 | 3.50 | 0.010 | 0.015 | — | — | — | — | 1.900 | 0.003 | — |
| 95 | 0.011 | 3.00 | 0.30 | 0.011 | 0.012 | 0.88 | 0.25 | 4.2 | — | 2.000 | 0.012 | — |
| 96 | 0.010 | 0.02 | 0.25 | 0.012 | 0.011 | 0.50 | — | — | — | 0.028 | 0.003 | 0.0004 |
| 97 | 0.055 | 0.05 | 0.32 | 0.015 | 0.014 | 0.47 | — | — | — | 0.033 | 0.004 | 0.0004 |
| 98 | 0.011 | 0.10 | 0.29 | 0.012 | 0.013 | 0.54 | — | — | — | 0.035 | 0.004 | 0.0004 |
| 99 | 0.009 | 0.10 | 0.50 | 0.011 | 0.015 | 0.92 | 0.04 | — | — | 0.033 | 0.007 | — |
| 100 | 0.015 | 0.04 | 0.31 | 0.009 | 0.006 | 0.66 | — | — | — | 0.026 | 0.004 | 0.0004 |
| 101 | 0.035 | 3.10 | 1.30 | 0.020 | 0.020 | 1.70 | — | — | — | 0.042 | 0.010 | — |

TABLE 3-continued

| Steel components (mass %) | | | | | | | | | | | | |
|---|---|---|---|---|---|---|---|---|---|---|---|---|
| 102 | 0.082 | 0.50 | 0.70 | 0.016 | 0.006 | 1.50 | — | — | — | 0.029 | 0.011 | — |

| Test No | B | Ti | Nb | V | Other elements | Di | Type |
|---|---|---|---|---|---|---|---|
| 41 | — | — | — | — | — | 61 | Comparative |
| 42 | — | — | — | — | — | 60 | Comparative |
| 43 | — | — | — | — | — | 61 | Comparative |
| 44 | — | — | — | — | — | 61 | Comparative |
| 45 | — | — | — | — | — | 93 | Comparative |
| 46 | — | — | — | — | — | 95 | Comparative |
| 47 | — | — | — | — | — | 105 | Comparative |
| 48 | — | — | — | — | — | 125 | Comparative |
| 49 | — | — | — | — | — | 191 | Comparative |
| 50 | — | — | — | — | — | 64 | Invention |
| 51 | — | — | — | — | — | 70 | Invention |
| 52 | 0.0010 | 0.023 | — | — | — | 71 | Invention |
| 53 | — | — | — | — | — | 75 | Invention |
| 54 | — | — | — | 0.11 | — | 81 | Invention |
| 55 | 0.0022 | 0.026 | — | — | — | 84 | Invention |
| 56 | — | 0.023 | — | — | — | 87 | Invention |
| 57 | — | — | — | — | — | 87 | Invention |
| 58 | — | 0.025 | — | — | zr: 0.0011 | 88 | Invention |
| 59 | 0.0019 | 0.018 | — | — | — | 89 | Invention |
| 60 | 0.0015 | 0.027 | — | — | — | 94 | Invention |
| 61 | 0.0023 | 0.024 | — | — | REM: 0.001 | 96 | Invention |
| 62 | 0.0022 | 0.110 | — | — | — | 96 | Invention |
| 63 | 0.0022 | 0.015 | 0.005 | 0.35 | — | 96 | Invention |
| 64 | 0.0015 | 0.023 | — | — | Ca: 0.0008 | 98 | Invention |
| 65 | 0.0017 | 0.025 | 0.011 | — | — | 101 | Invention |
| 66 | 0.0016 | 0.022 | — | — | Te: 0.001 | 105 | Invention |
| 67 | 0.0016 | 0.023 | — | — | — | 110 | Invention |
| 68 | 0.0071 | — | — | — | — | 113 | Invention |
| 69 | 0.0018 | 0.023 | — | — | — | 117 | Invention |
| 70 | 0.0014 | 0.020 | — | — | — | 122 | Invention |
| 71 | — | — | — | — | — | 125 | Invention |
| 72 | — | — | — | — | — | 127 | Invention |
| 73 | 0.0021 | 0.022 | — | — | — | 128 | Invention |
| 74 | 0.0018 | 0.020 | — | — | — | 133 | Invention |
| 75 | — | — | — | — | — | 133 | Invention |
| 76 | 0.0015 | 0.024 | — | — | — | 161 | Invention |
| 77 | — | — | — | — | — | 162 | Invention |
| 78 | 0.0015 | 0.019 | — | — | — | 166 | Invention |
| 79 | 0.0012 | 0.021 | — | — | — | 201 | Invention |
| 80 | 0.0022 | 0.025 | — | — | — | 220 | Invention |
| 81 | 0.0016 | 0.021 | — | — | — | 226 | Invention |
| 82 | 0.0010 | 0.022 | — | — | — | 234 | Invention |
| 83 | 0.0055 | — | — | — | — | 242 | Invention |
| 84 | — | — | — | — | — | 243 | Invention |
| 85 | 0.0015 | 0.019 | — | — | — | 248 | Invention |
| 86 | 0.0010 | 0.022 | — | — | Mg: 0.0009 | 252 | Invention |
| 87 | — | — | — | — | — | 255 | Invention |
| 88 | 0.0012 | 0.019 | — | — | — | 285 | Invention |
| 89 | — | — | — | — | — | 299 | Invention |
| 90 | — | — | — | — | — | 308 | Invention |
| 91 | 0.0022 | 0.022 | — | — | — | 312 | Invention |
| 92 | — | — | — | — | — | 314 | Invention |
| 93 | 0.0015 | 0.025 | — | — | — | 546 | Invention |
| 94 | — | — | — | — | — | 810 | Invention |
| 95 | — | — | — | — | — | 3689 | Invention |
| 96 | 0.0020 | 0.026 | — | — | — | 41 | Comparative |
| 97 | 0.0022 | 0.023 | — | — | — | 46 | Comparative |
| 98 | 0.0021 | 0.023 | — | — | — | 49 | Comparative |
| 99 | — | — | — | — | — | 52 | Comparative |
| 100 | 0.0023 | 0.029 | — | — | — | 54 | Comparative |
| 101 | — | — | — | — | — | 441 | Comparative |
| 102 | — | — | — | — | — | 103 | Comparative |

Samples cut from the steel bars of Table 3 and ground into cylindrical test pieces of 8 mm diameter by 12 mm length were subjected to compression testing at a strain rate of 10/s at the temperatures indicated in Table 4. The maximum flow stress up to equivalent strain of 0.5 was investigated.

Samples cut from the steel bars and ground into cylindrical test pieces of 17.5 mm diameter by 52.5 mm length were subjected to heat treatment combining gas carburization/quenching, vacuum carburization/quenching, or carbonitriding/quenching with ensuing high-frequency induction heating. The gas carburization was conducted at 950° C. under carbon potential of 1.1% for 176 min and then carbon potential of 0.8% for 110 min, followed by quenching and tempering at 160° C. In addition, gas carburization was also conducted at the level of long-duration carburization at 950° C. under carbon potential of 1.1% for 234 min and then carbon potential of 0.8% for 146 min, followed by quenching and tempering at 160° C. The vacuum carburization was conducted at 940° C. for 200 min, followed by quenching and tempering at 160° C. In addition, vacuum carburization was also conducted on a long-duration level at 940° C. for 265 min, followed by quenching and tempering at 160° C. Carbonitriding was conducted by carburization at 940° C., carbon potential of 0.8%, and then nitriding by lowering the temperature of the same furnace to 840° C. and adding $NH_3$ to a concentration of 7%, followed by quenching. The high-frequency induction heating was done at 900° C., followed by water quenching. All tempering was conducted at 160° C. Next, the test piece was cut crosswise, the cross-sectional surface was polished, and the HV hardness distribution in the cross-section was measured inward from the test piece surface under 200 g load using a micro Vickers hardness tester, thereby determining the effective hardening depth.

The results of the foregoing study are shown in Table 4. The bcc fractions (%) at the forging temperature are also shown in Table 4. The bcc fractions were calculated by computer from the components (%) shown in Table 3 and the forging temperatures (° C.) shown in Table 4 using the Thermo-Calc program available from Thermo-Calc Software.

TABLE 4

| Test No. | Forging temp. (° C.) | bcc fraction (%) at forging temp (%) | Deformation resistance at forging temp (MPa) | Heat treatment | Effective hardening depth (mm) | Type |
|---|---|---|---|---|---|---|
| 41 | 800 | 24 | 250 | Gas carburization→Quenching→Tempering | 0.88 | Comparative |
| 42 | 850 | 0 | 225 | Gas carburization→Quenching→Tempering | 0.88 | Comparative |
| 43 | 900 | 0 | 209 | Vacuum carburization→Quenching→Tempering | 0.88 | Comparative |
| 44 | 1200 | 0 | 85 | Vacuum carburization→Quenching→Tempering | 0.88 | Comparative |
| 45 | 850 | 0 | 234 | Gas carburization→Quenching→Tempering | 0.88 | Comparative |
| 46 | 850 | 0 | 235 | Gas carburization→Quenching→Tempering | 0.88 | Comparative |
| 47 | 850 | 0 | 227 | Gas carburization→Quenching→Tempering | 0.88 | Comparative |
| 48 | 850 | 0 | 230 | Gas carburization→Quenching→Tempering | 0.88 | Comparative |
| 49 | 850 | 0 | 241 | Gas carburization→Quenching→Tempering | 0.86 | Comparative |
| 50 | 850 | 67 | 125 | Gas carburization→Quenching→Tempering | 0.76 | Invention |
| 51 | 850 | 66 | 125 | Gas carburization→Quenching→Tempering | 0.75 | Invention |
| 52 | 850 | 86 | 126 | Gas carburization→Quenching→Tempering | 0.74 | Invention |
| 53 | 850 | 75 | 136 | Gas carburization→Quenching→Tempering | 0.80 | Invention |
| 54 | 850 | 66 | 128 | Gas carburization→Quenching→Tempering | 0.78 | Invention |
| 55 | 800 | 86 | 165 | Gas carburization→Quenching→Tempering | 0.84 | Invention |
| 56 | 850 | 60 | 126 | Carbonitriding→High-frequency heating→Quenching→Tempering | 0.88 | Invention |
| 57 | 850 | 68 | 130 | Gas carburization→Quenching→Tempering | 0.86 | Invention |
| 58 | 850 | 70 | 137 | Gas carburization→Quenching→Tempering | 0.78 | Invention |
| 59 | 850 | 92 | 125 | Gas carburization→Quenching→Tempering | 0.78 | Invention |
| 60 | 850 | 92 | 140 | Gas carburization→Quenching→Tempering | 0.81 | Invention |
| 61 | 850 | 81 | 133 | Gas carburization→Quenching→Tempering | 0.78 | Invention |
| 62 | 850 | 98 | 152 | Gas carburization→Quenching→Tempering | 0.79 | Invention |
| 63 | 850 | 97 | 141 | Gas carburization→Quenching→Tempering | 0.79 | Invention |
| 64 | 850 | 56 | 165 | Gas carburization→Quenching→Tempering | 0.79 | Invention |
| 65 | 850 | 76 | 138 | Gas carburization→Quenching→Tempering | 0.79 | Invention |
| 66 | 850 | 99 | 129 | Gas carburization→High-frequency heating→Quenching→Tempering | 0.88 | Invention |
| 67 | 850 | 87 | 129 | Gas carburization→Quenching→Tempering | 0.86 | Invention |
| 68 | 850 | 99 | 141 | Gas carburization→Quenching→Tempering | 0.80 | Invention |
| 69 | 850 | 83 | 158 | Gas carburization→Quenching→Tempering | 0.84 | Invention |
| 70 | 850 | 100 | 153 | Gas carburization→Quenching→Tempering | 0.80 | Invention |
| 71 | 900 | 81 | 105 | Vacuum carburization→Quenching→Tempering | 0.86 | Invention |
| 72 | 850 | 68 | 161 | Gas carburization→Quenching→Tempering | 0.84 | Invention |
| 73 | 900 | 72 | 120 | Vacuum carburization→Quenching→Tempering | 0.80 | Invention |
| 74 | 850 | 80 | 130 | Gas carburization→Quenching→Tempering | 0.86 | Invention |
| 75 | 850 | 87 | 142 | Gas carburization→Quenching→Tempering | 0.80 | Invention |
| 76 | 850 | 74 | 131 | Gas carburization→Quenching→Tempering | 0.86 | Invention |
| 77 | 850 | 64 | 133 | Gas carburization→Quenching→Tempering | 0.86 | Invention |
| 78 | 900 | 90 | 105 | Vacuum carburization→Quenching→Tempering | 0.85 | Invention |
| 79 | 800 | 89 | 141 | Gas carburization→Quenching→Tempering | 0.82 | Invention |
| 80 | 850 | 94 | 130 | Vacuum carburization→Quenching→Tempering | 0.85 | Invention |
| 81 | 850 | 94 | 151 | Gas carburization→Quenching→Tempering | 0.86 | Invention |
| 82 | 900 | 81 | 110 | Vacuum carburization→Quenching→Tempering | 0.85 | Invention |
| 83 | 850 | 53 | 154 | Gas carburization→Quenching→Tempering | 0.82 | Invention |
| 84 | 900 | 100 | 112 | Vacuum carburization→Quenching→Tempering | 0.86 | Invention |
| 85 | 850 | 48 | 150 | Long-duration gas carburization→Quenching→Tempering | 0.96 | Invention |
| 86 | 850 | 93 | 153 | Gas carburization→Quenching→Tempering | 0.86 | Invention |
| 87 | 850 | 59 | 151 | Gas carburization→Quenching→Tempering | 0.85 | Invention |
| 88 | 850 | 100 | 140 | Vacuum carburization→Quenching→Tempering | 0.88 | Invention |
| 89 | 1200 | 100 | 40 | Long-duration vacuum carburization→Quenching→Tempering | 0.93 | Invention |
| 90 | 900 | 100 | 113 | Vacuum carburization→Quenching→Tempering | 0.86 | Invention |
| 91 | 850 | 66 | 142 | Vacuum carburization→Quenching→Tempering | 0.88 | Invention |
| 92 | 900 | 100 | 101 | Vacuum carburization→Quenching→Tempering | 0.88 | Invention |
| 93 | 1200 | 100 | 41 | Long-duration vacuum carburization→Quenching→Tempering | 0.91 | Invention |
| 94 | 850 | 97 | 172 | Vacuum carburization→Quenching→Tempering | 0.88 | Invention |
| 95 | 850 | 66 | 162 | Vacuum carburization→Quenching→Tempering | 0.87 | Invention |

TABLE 4-continued

| Test No. | Forging temp. (° C.) | bcc fraction (%) at forging temp (%) | Deformation resistance at forging temp (MPa) | Heat treatment | Effective hardening depth (mm) | Type |
|---|---|---|---|---|---|---|
| 96 | 850 | 100 | 124 | Gas carburization→Quenching→Tempering | 0 | Comparative |
| 97 | 850 | 51 | 166 | Gas carburization→Quenching→Tempering | 0 | Comparative |
| 98 | 850 | 93 | 125 | Gas carburization→Quenching→Tempering | 0 | Comparative |
| 99 | 850 | 85 | 128 | Gas carburization→Quenching→Tempering | 0.46 | Comparative |
| 100 | 850 | 86 | 126 | Gas carburization→Quenching→Tempering | 0.47 | Comparative |
| 101 | 850 | 82 | 192 | Gas carburization→Quenching→Tempering | 0.30 | Comparative |
| 102 | 850 | 11 | 219 | Gas carburization→Quenching→Tempering | 0.78 | Comparative |

The steels used in Test No. 41 to Test No. 44 were JIS SCr420 comparative steels with a C content of 0.2% and Di values of 60 to 61. The invention steels used in Test No. 50 to Test No. 95 were these steels lowered in deformation resistance during forging in the high-temperature zone. The steels compared in forging at 800° C. were the steel of Text No. 41 and the invention steel of Test No. 55. The steels compared in forging at 850° C. were the steel of Text No. 42 and the invention steels of Test No. 50 to Test No. 54, Test No. 56 to Test No. 70, Test No. 72, Test No. 74 to Test No. 77, Test No. 80, Test No. 81, Test No. 83, Test No. 85 to Test No. 88, Test No. 91, Test No. 94 and Test No. 95. The steels compared in forging at 900° C. were the steels of Test No. 43 and the invention steels of Test No 71. Test No. 73, Test No. 78, Test No. 82, Test No. 84, Test No. 90 and Test No. 92. The steels compared in forging at 1,200° C. were the steels of Test No. 44 and the invention steels of Test No 89 and Test No. 93. All of the invention steels were greatly reduced in deformation resistance. The steels of Test No. 41 to Test No. 44 were low in soft bcc phase at all forging temperatures. In contrast, the invention steels, which were not only reduced in content of alloying elements high in solid solution strengthening capacity but also variously regulated in chemical composition, were high in soft bcc phase fraction and achieved reduced deformation resistance.

The effective hardening depths of the invention steels with low Di values were about 85% those of the comparative steels of Test No. 41 to Test No. 44 and were in all cases 0.6 mm or greater. Moreover, the steel of Test No. 56, which was subjected to carbonitriding→high-frequency heating→quenching→tempering, and the steel of Test No. 66, which was subjected to gas carburization→high-frequency heating→quenching→tempering, and the steels of Test No. 85, Test No. 89 and Test No. 93, which were subjected to long-duration carburization→quenching→tempering, had effective hardening depths of 0.88 mm or greater despite being low in Di.

The steel used in Test No. 45 was an SAE 8620 comparative steel with a C content of 0.2% and a Di of 93. Where the steel is to be soften while maintaining this Di, the invention steels used in Test No. 60 to Test No. 95 are suitable. When the hardened component is small, it is of course possible to utilize any of the steels used in Test No. 50 to Test No. 95.

The steel used in Test No. 46 was a JIS SNCM220 comparative steel with a C content of 0.2% and a Di of 95. Where the steel is to be soften while maintaining this Di, the invention steels used in Test No. 61 to Test No. 95 are suitable. When the hardened component is small, it is of course possible to utilize any of the steels used in Test No. 50 to Test No. 95.

A steel with a large Di is generally used for a large component. In the case of the invention steels, it is similarly possible to use an invention steel with a large Di for a large component.

Moreover, Di is not the only factor determining the properties of a steel and, for example, toughness may be enhanced by adding Ni. In such a case, Di is maintained by adding Ni to a content within the range defined by the invention chemical composition.

The steel used in Test No. 47 was a DIN 20MnCr5 comparative steel with a C content of 0.2% and a Di of 105. Where the steel is to be soften while maintaining this Di, the invention steels used in Test No. 66 to Test No. 95 are suitable. When the hardened component is small, it is of course possible to utilize any of the steels used in Test No. 50 to Test No. 95.

The steel used in Test No. 48 was a JIS SCM420 comparative steel with a C content of 0.2% and a Di of 125. Where the steel is to be soften while maintaining this Di, the invention steels used in Test No. 71 to Test No. 95 are suitable. When the hardened component is small, it is of course possible to utilize any of the steels used in Test No. 50 to Test No. 95.

The steel used in Test No. 49 was a JIS SNCM815 comparative steel with a C content of 0.15% and a Di of 191. Where the steel is to be soften while maintaining this Di, the invention steels used in Test No. 79 to Test No. 95 are suitable. When the hardened component is small, it is of course possible to utilize any of the steels used in Test No. 50 to Test No. 95.

The steel used in Test No. 96 had a Di below the invention range. Since its hardenability was therefore insufficient, it achieved a hardness after carburization, quenching/hardening and tempering of only about Hv 400 even at the outermost surface layer. As a result, its effective hardening depth, i.e., depth to the portion having a hardness of Hv 550, was 0 mm. The steels of Test No. 97 and Test No. 98 had Di values below the invention range. Since their hardenabilities were therefore insufficient, they achieved hardnesses after carburization, quenching/hardening and tempering of only about Hv 500 even at the outermost surface layer. As a result, their effective hardening depths, i.e., depths to the portion having a hardness of Hv 550, was 0 mm. The steels of Test No. 99 and Test No. 100 had Di values below the invention range. Since their hardenabilities were therefore insufficient, they had insufficient effective hardening depths after carburization, quenching/hardening and tempering. The steel of Test No. 101 had an Si content above the invention range. Since its carburizability was therefore inferior, no effective hardened layer was obtained. The steel of Test No. 102 had a C content above the invention range and was therefore high in deformation resistance.

INDUSTRIAL APPLICABILITY

The present invention greatly reduces steel deformation resistance during cold, warm and hot forging and provides a steel exhibiting required strength after heat treatment following forging, thereby markedly improving component production efficiency.

What is claimed is:

1. A forging steel consisting of, in mass %:

C: 0.001 to less than 0.03%,

Si: 3.0% or less,

Mn: 0.01 to 4.0%,

Cr: 5.0% or less,

P: 0.2% or less,

S: 0.35% or less,

Al: greater than 0.06 to 2.0%,

N: 0.03% or less,

B: not less than BL given by Equation (7) below and not greater than 0.008%,

Ti: 0.005 to 0.15%, and

Mg: 0.0002 to 0.003%, one or both of Mo: 1.5% or less (including 0%) and Ni: 4.5% or less (including 0%), and a balance of iron and unavoidable impurities; and optionally, one or more of Nb, V, Te, Ca, Zr, and REM; wherein Di given by the following Equation (3) is 60 or greater:

$$Di=5.41\times Di(\mathrm{Si})\times Di(\mathrm{Mn})\times Di(\mathrm{Cr})\times Di(\mathrm{Mo})\times Di(\mathrm{Ni})\times Di(\mathrm{Al})\times 1.976 \quad (3),$$

where

Di(Si)=0.7×[% Si]+1,

Di(Mn)=3.335×[% Mn]+1 when Mn≤1.2%,

Di(Mn)=5.1×[% Mn]−1.12 when 1.2%<Mn,

Di(Ni)=0.3633×[% Ni]+1 when Ni≤1.5%,

Di(Ni)=0.442×[% Ni]+0.8884 when 1.5%<Ni≤1.7%,

Di(Ni)=0.4×[% Ni]+0.96 when 1.7%<Ni≤1.8%,

Di(Ni)=0.7×[% Ni]+0.42 when 1.8%<Ni≤1.9%,

Di(Ni)=0.2867×[% Ni]+1.2055 when 1.9%<Ni,

Di(Cr)=2.16×[% Cr]+1,

Di(Mo)=3×[% Mo]+1,

Di(Al)=1 when Al≤0.05%, and

Di(Al)=4×[% Al]+1 when 0.05%<Al, $$\text{wherein } BL=0.0004+10.8/14\times([\%\ \mathrm{N}]-14/47.9\times[\%\ \mathrm{Ti}]) \quad (7)$$

where ([% N]−14/47.9×[% Ti]) of less than 0 is treated as 0, a symbol in brackets [ ] indicating content (mass %) of the element concerned, and wherein a deformation resistance at room temperature is not more than 563 MPa.

2. The forging steel according to claim 1, wherein one or more of Nb, V, Te, Ca, Zr, and REM is present in the following amounts:

Nb: 0.005 to 0.1%,

V: 0.01 to 0.5%,

Te: 0.0002 to 0.003%,

Ca: 0.0003 to 0.003%,

Zr: 0.0003 to 0.005%, and

REM: 0.0003 to 0.005%.

* * * * *